United States Patent [19]

Bukowski et al.

[11] Patent Number: 4,550,380

[45] Date of Patent: Oct. 29, 1985

[54] MICROPROCESSOR-BASED EXTRACTION TURBINE CONTROL

[75] Inventors: James M. Bukowski; Gary E. Midock, both of Pittsburgh; Ronald J. Walko, Bethel, all of Pa.

[73] Assignee: Westinghouse Electric Corp., Pittsburgh, Pa.

[21] Appl. No.: 562,507

[22] Filed: Dec. 16, 1983

[51] Int. Cl.[4] ..... G06F 15/46; H02P 9/04

[52] U.S. Cl. ..... 364/494; 60/645; 60/660; 364/180; 415/17

[58] Field of Search ..... 364/492, 494, 180, 181, 364/160; 290/40 R; 415/1, 13, 15, 17; 60/645, 660

[56] References Cited

U.S. PATENT DOCUMENTS

| | | | |
|---|---|---|---|
| 3,925,645 | 12/1975 | Stern | 364/180 X |
| 4,029,255 | 6/1977 | Heiser et al. | 364/494 |
| 4,053,745 | 10/1977 | Podolsky et al. | 364/494 |
| 4,427,896 | 1/1984 | Waldron | 364/494 X |
| 4,494,208 | 1/1985 | Chang | 364/494 |

*Primary Examiner*—Joseph Ruggiero
*Attorney, Agent, or Firm*—W. E. Zitelli

[57] ABSTRACT

A microprocessor-based controller for an extraction type steam turbine-generator unit capable of selecting from a variety of predetermined control strategies and implementing corresponding valve position control loops by generating appropriate valve position control signals in accordance with operator-chosen setpoint signals and turbine operating level signals. The extraction mode of turbine operation is subdivided into a provided set of mutually exclusive extraction control loops, each of which can be placed in service in a bumpless fashion upon transition from any other extraction control loop in a predetermined sequence. Upon a return from the manual mode of turbine operation to the automatic mode, a particular extraction control loop is automatically placed in service without the need for operator intervention.

14 Claims, 6 Drawing Figures

MICROPROCESSOR-BASED EXTRACTION TURBINE CONTROL

CROSS-REFERENCE TO RELATED APPLICATIONS

The present application is related to two concurrently filed patent applications bearing Ser. Nos. 562,378 and 562,508 by the same inventors, which are assigned to the same assignee as the present application, the disclosures of which are incorporated herein by reference.

BACKGROUND OF THE INVENTION

The invention relates to steam turbine control systems, more particularly to a control system for an extraction type steam turbine.

A common aspect of many industrial environments is the required simultaneous provision of adequate process steam and electric power. Extraction turbines allow a portion of their inlet steam flow to be directed to a process steam header by use of an extraction valve. They are widely used in industrial environments for cogeneration of process steam and electric power requirements because of their ability to accurately match these requirements in a balanced and stable fashion. In any given industrial plant, these requirements vary over time and an extraction turbine control system attempting to provide and match these requirements must respond accordingly.

Industrial utilization of extraction turbines requires appropriate adjustment of front-end extraction turbine control valves and the extraction valve. These adjustments are made through application of well-known valve position control loop technology.

A control loop is established by a combination of signals, including one representing the desired level of turbine operation, and one representing the existing level of turbine operation. A prior art analog controller functions in the control loop to compare these two signals, and noting any discrepancy, it operates to automatically bring the turbine operation to that level required to balance these signals. The particular combination of signal elements in a control loop reflects the control strategy used by the system designer. The combined operation of several control loops achieves the overall control philosophy used in the control system design.

The majority of extraction turbines in service are used in the industrial area—steel mills, refineries, paper mills, sewage treatment plants, etc., where in the past generation of electricity by the extraction turbine was a byproduct and not really a necessity. The major use of the extraction turbine in these cases was for process steam availability.

In the prior art of extraction turbine control system design, emphasis was placed on control of the process steam extraction operation so as to achieve the extraction process steam pressure required by the industrial plant. Extraction process steam pressure is the important control parameter where the extraction process steam is being used to feed heaters in the plant, such as auxiliary heaters, furnace heaters and building heaters, or where the steam is being used to power steam-driven pumps.

Other uses of extraction process steam include various quenching processes associated with steel mill operations, such as coke-quenching and quenching of hot metal strip as it exits the rolling mill. In these uses, the important control parameter is mass flow of extraction process steam.

For a given extraction steam pipe arrangement, control of either pressure or flow at a specific value necessarily corresponds to a specific value of the other parameter, though uncontrolled. The control scheme for control of either parameter adjusts the extraction valve in accordance with plant requirements. The ability of the control system to switch control modes from a pressure control mode to a flow control mode takes on increasing importance with the expansion in the number of possible ways to utilize the extraction process steam in the industrial process.

Prior art extraction turbine control systems required an operator to perform a complex, lengthy and delicate set-up procedure to accomplish this transfer of control modes. A major difficulty of this set-up procedure was presented by the requirement that it was performed so as to avoid a process upset, that is, that it was bumpless. Therefore, in a transfer from a pressure control mode to a flow control mode, the operator had to establish the flow setpoint at the mass flow value already existing while in the pressure control mode. This required visual comparison of various measurement parameters, introducing the possibility of operator error which would create a large swing in the controlled parameter as the new control mode was entered.

The operator's set-up procedure in all of these cases was further complicated by the need to readjust settings due to the drift introduced by prior art analog control system circuitry which depended on discrete electronic components such as operational amplifiers, capacitors, diodes and resistors, etc. These circuits were prone to drift out of calibration over time and with temperature variations.

With unceasing increases in the costs of energy, personnel and equipment, the inadequacies of older extraction turbine control strategies have become magnified. The potential for operating cost reductions may be available through the application of industrial energy management systems. These optimization systems are arranged to provide the front-end plant boiler controls with the steam pressure, steam flow, and electrical energy requirements for the entire industrial plant. In order for optimization to occur, the boiler controls must be able to transmit to the extraction turbine control system the required level of extraction steam pressure and/or flow and/or megawatt output. Use of the boiler control system as a remote control system to automatically send into the extraction turbine control system all of the various process setpoints requires the provision of an extraction turbine control system capable of responding to them and moving its operational level in a bumpless fashion, without the need for operator intervention.

It can be seen that prior art extraction turbine control systems reflected control strategries which did not fully exploit the extraction turbine capabilities noted earlier. It would therefore be desirable to provide a method for selection, from multiple available control loops, a particular control loop or combination of control loops reflecting a particular control strategy or strategies. It would also be desirable to provide a simplified method of extraction turbine control to fully utilize the capabilities of the extraction turbine in meeting industrial process steam and electrical energy requirements. It would also be desirable to provide an extraction turbine control system that makes more efficient use of the extraction turbine by achieving tight control of extraction process steam requirements during various process steam extraction modes. It would also be desirable to provide an extraction turbine control system with control loops that are free from drift in calibration of circuit components, thereby reducing periodic maintenance requirements. It would also be desirable to provide an extraction turbine control system that is capable of accepting remotely generated optimization setpoint signals and adjusting its operational level in accordance therewith, without the need for operator intervention once the operator has chosen a remote mode. Such a control system would enable the realization of front-end boiler fuel cost reductions because of the smoother boiler operation associated with better and more stable extraction turbine control.

SUMMARY OF THE INVENTION

An extraction type steam turbine-generator unit is provided with a microprocessor-based controller for selecting predetermined control strategies and implementing corresponding valve position control loops by generating appropriate valve position control signals in accordance with either remotely generated or operator-chosen setpoint signals and turbine operating level signals. A method of bumpless transfer between mutually exclusive extraction control loops directed to pressure or flow control is disclosed. Two transition setpoint controllers are provided, one for a transition to a pressure control mode and one for a transition to a flow control mode. Depending on which transition is in progress, each transition setpoint controller operates with an extraction transition reference controller which examines the process variable present in the existing level of turbine operation, and the appropriate transition setpoint controller then operates to produce an extraction valve setpoint signal equal to that process variable value, so as to provide bumpless transfer upon transition to the new control mode. Upon a return from the manual mode of turbine operation to the automatic mode, a particular extraction control loop is automatically placed in service without the need for operator intervention.

BRIEF DESCRIPTION OF THE DRAWINGS

FIGS. 3, 4 and 5 show an extraction turbine control system arranged in accordance with the principles of the invention, in which:

FIG. 3 shows an operator's panel, an extraction control loop selection controller and a reinsertion logic controller;

FIG. 4 shows an extraction valve transition reference selection controller;

FIG. 5 shows an extraction valve pressure transition setpoint controller, an extraction valve flow transition setpoint controller, an extraction valve setpoint selection controller, and an extraction turbine arrangement.

DESCRIPTION OF THE PREFERRED EMBODIMENT

Figure 1:
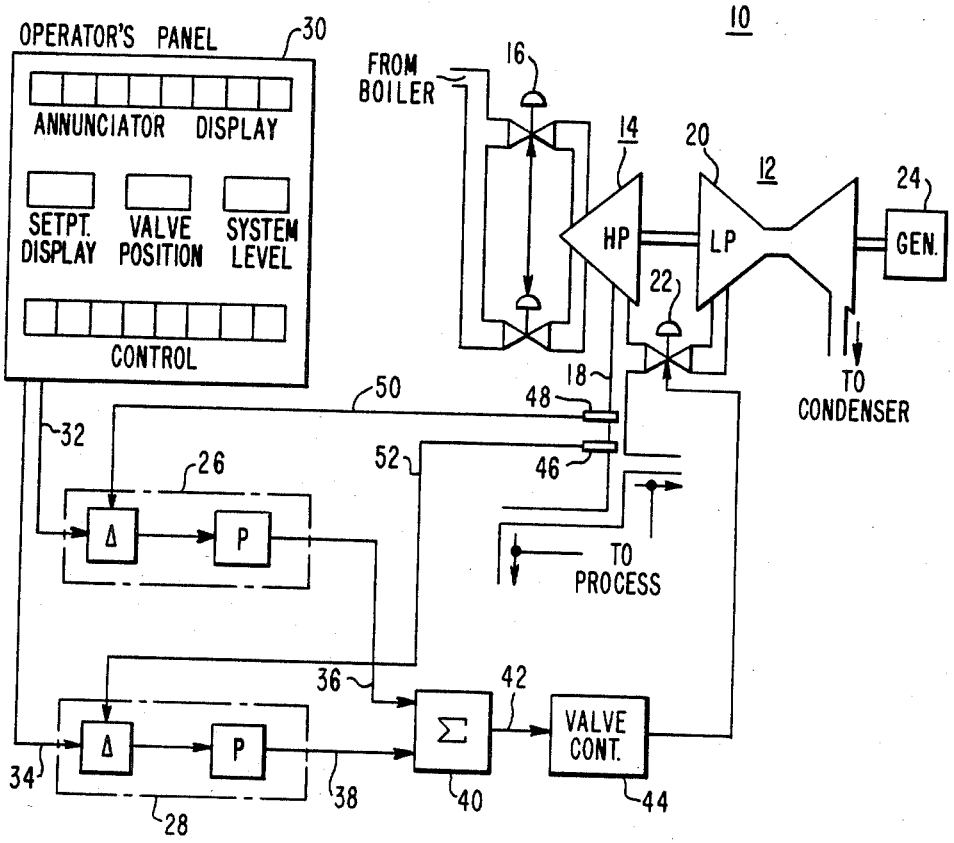
FIG. 1 PRIOR ART
FIG. 1 shows an extraction turbing plant operated by a typical prior art control system.

With reference to FIG. 1, a typical prior art extraction steam turbine control system 10 is shown in which an extraction turbine 12 is fed with inlet steam at a fixed temperature and pressure from a boiler (not shown) which enters at the high pressure (HP) section 14 of the extraction turbine 12 through a pair of upper and lower control valve 16. The steam drives the HP turbine blades and then exits the seventh stage of the HP section 14 to the industrial process steam header or extraction cavity 18 and to the low pressure (LP) section 20 of the extraction turbine 12.

Maximum steam flow to the plant process where it is to be used corresponds to a minimum opening of the extraction valve 22. However, the extraction valve 22 is kept from fully closing to maintain a flow of cooling steam to the LP section 20 of the extraction turbine 12, which overcomes the heat generated by the friction of the moving LP blades in the dense atmosphere of steam. An electric power generator 24 is coupled to the turbine shaft for production of electric power for use in the plant process, or possibly for sale to the electric utility power grid (not shown).

The extraction turbine 12 is stated in a conventional manner and after being loaded, the generator 24 is producing megawatts and the extraction valve 22 is wide open, corresponding to no extraction steam demand in an initial system operating mode. When extraction steam demand is present, control of the extraction steam operation is provided by two independent setpoint signal proportional (P) controllers, the extraction valve flow setpoint signal controller 26 and the extraction valve pressure setpoint signal controller 28. Each setpoint signal controller interfaces with the operator's panel 30 for establishing the level of performance within the processs steam extraction mode of turbine operation, as represented by the two extraction reference signals, the extraction flow reference signal 32 and the extraction pressure reference signal 34. The extraction valve flow setpoint signal 36 and the extraction valve pressure setpoint signal 38 are each fed to a signal summer 40. Depending on which mode of operation is in progress, the extraction valve setpoint signal 42 will be determined by the greater of these two signals, and this signal is then fed to a valve controller 44, typically an electrohydraulic valve servo and servo driver loop for positioning the extraction valve 22. A steam pressure transducer 46 and a steam flow transducer 48 on the industrial process steam header 18 provide feedback signals 52 and 50 to the respective extraction valve setpoint signal controllers 28 and 26 to maintain a stable extraction operation.

As noted earlier, this scheme provides pressure control or flow control of an extraction process steam operation. However, the transition from one of these modes to the other requires the operator to perform a complicated procedure to adjust the extraction valve setpoint in the new control mode properly so as to avoid a process upset upon transition.

The present invention provides a microprocessor-based extraction turbine control system having a set of mutually exclusive modes of extraction operation through use of individual extraction control loops. Four extraction control loops are provided. These are the local extraction pressure control loop, the local extraction flow control loop, the remote extraction pressure control loop, and the remote extraction flow control loop.

While in automatic system control, each of thse control loops operates independently of a provided megawatt load control loop with separate control outputs derived from process feedback. These individual extraction control loops are arranged so as to allow a bumpless transfer between the local extraction pressure control loop and any other extraction control loop, thus avoiding any process upset. Additionally, the present invention is capable of automatic reinsertion of the local extraction pressure control loop upon a return from manual to automatic system control.

Figure 2:
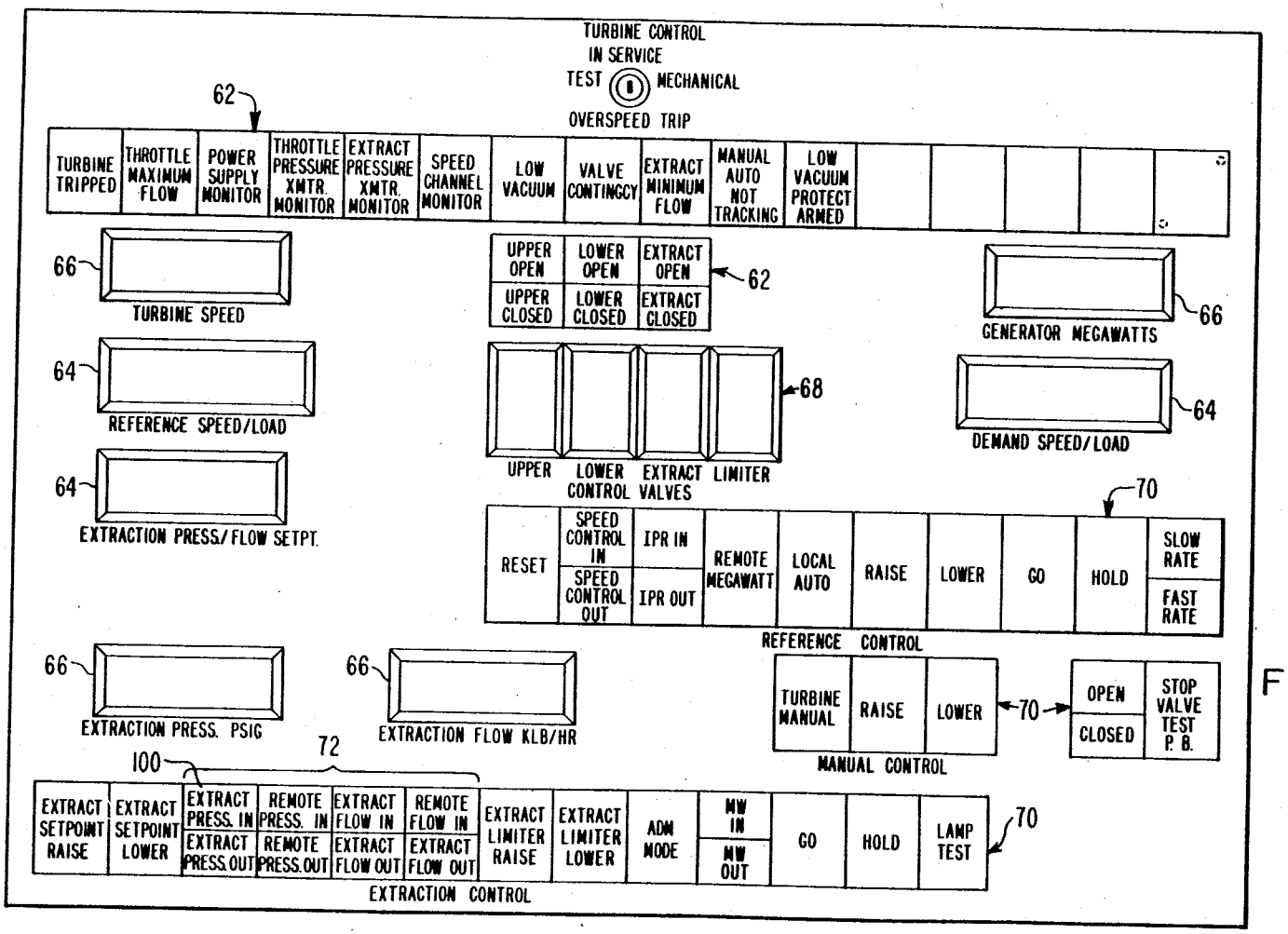
FIG. 2 shows a detail of the operator's panel portion of the present invention.

FIG. 2 shows a detail of the operator's panel 60 portion of the extraction control system practiced in accordance with the present invention. The panel includes an annunciator display 62 indicating system abnormalities, several digital readout displays, a group 64 indicating desired system operation levels and a group 66 indicating actual system operation levels, valve position panel meters 68, and a series of control pushbuttons 70 for megawatt control, extraction control and manual control. The control pushbuttons 70 allow the operator both to select the system operation mode and to establish the desired level of operation within the selected mode.

Operator selection of the extraction control loop under which the extraction operation will proceed is made through pushbutton selection in the extraction control pushbutton group 72 on the operator's panel 60. Based on this selection, the extraction control loop selection controller 74 shown in FIG. 3, generates logic control signals 75, 76, 77 and 78 representing this selection. The extraction valve transition reference selection controller 80, shown in FIG. 4, responds to this selection and in turn provides an extraction transition reference signal 82 to one of two extraction valve transition setpoint controllers 84 and 86, shown in FIG. 5. The extraction valve setpoint selection controller 88 then selects and feeds the appropriate extraction valve setpoint signal 89 to the valve controller 90, in a bumpless fashion. Thus, the system is not disturbed upon a transition from the local extraction pressure control loop to any other extraction control loop, as further described herein.

Figure 5:
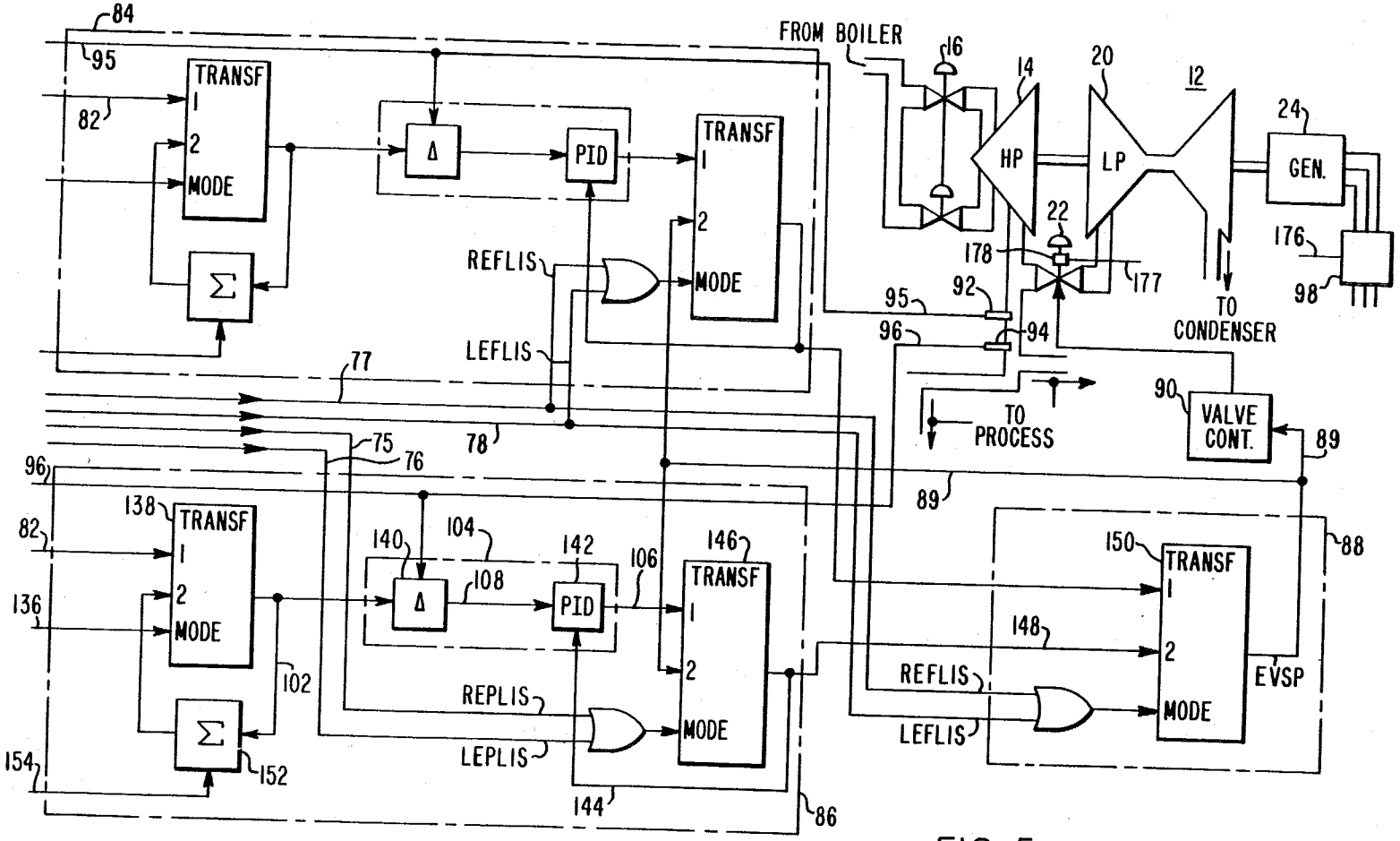

With reference to FIG. 5, before any extraction mode is entered, the extraction turbine 12 must be in the megawatt load control mode and the flow and pressure transmitters 92 and 94 as well as their respective flow and pressure feedback process variable signals 95 and 96 must not have failed. It is assumed that the extraction valve 22 is wide open at this point, permitting full steam flow through the extraction turbine 12. This is known as the full condensing mode. When the operator closes the generator breaker 98, an extraction limiter (not shown) automatically sets a minimum limit on the extraction valve 22 opening, at 20%, to maintain a minimum flow of cooling steam to LP section 20 of the extraction turbine 12 as noted earlier. Having closed the generator breaker 98, the extraction turbine 12 begins to pick up load on the electric power grid system (not shown). The operator must raise the load on the extraction turbine 12 to a 20% level to enable an extraction operation. The extraction control pushbuttons 72 are ignored below this load level.

To begin extracting steam, the operator must select the local extraction pressure control loop as the base mode of extraction operation, via pushbutton 100 on the operator's panel 60 (see FIG. 2). No other extraction control loop can be selected without the local extraction pressure control loop operating first. Once the local extraction pressure control loop is operating, the operator can select local flow or any of the remote extraction control loops by depressing the appropriate bushbutton in the extraction control pushbutton group 72.

Just prior to entering the local extraction pressure control mode, which corresponds to operation of the local extraction pressure control loop, the extraction pressure feedback process variable signal 96 (see FIG. 4) will have a value corresponding to the full condensing mode of operation. As noted earlier, this is the situation in which the extraction valve 22 is 100% open with full steam flow to the LP end 20 of the extraction turbine 12. Upon entering the local extraction pressure control mode, the extraction transition reference signal 82 is set equal to the extraction pressure feedback process variable signal 96, thereby making the transition to the local extraction pressure control loop bumpless. The extraction transition reference signal 82 becomes the extraction pressure reference signal 102 (see FIG. 5) which serves as a reference signal to the extraction pressure PID controller 104. The extraction valve pressure setpoint signal 106 is a PID (proportional plus intetral plus derivative) function of the error signal 108, which error signal 108 is the difference between the extraction pressure process variable signal 96 and the extraction pressure reference signal 102.

Figure 3:
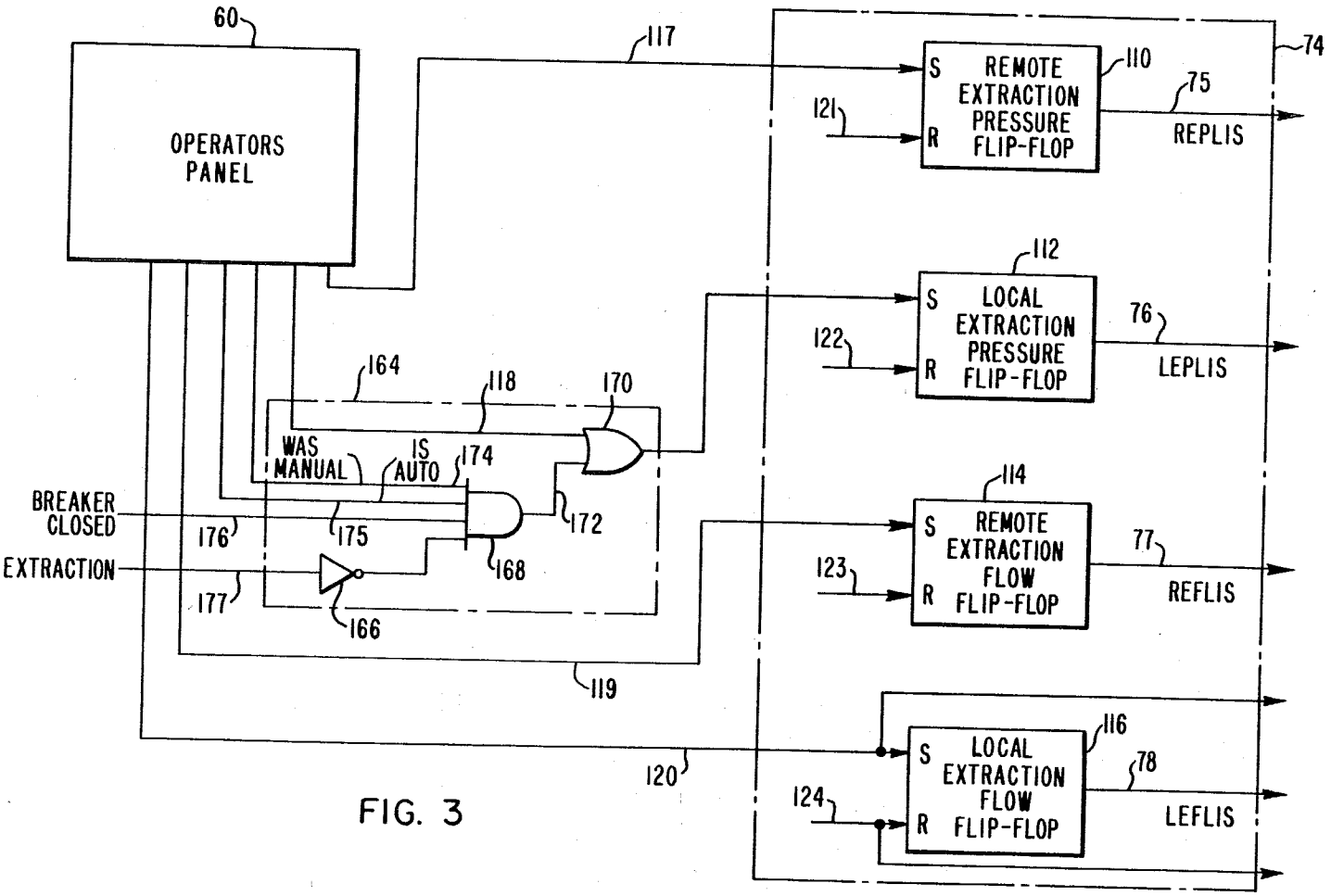

With reference to FIG. 3, the extraction control loop selection controller 74 employs four set-reset type flip-flop functional control blocks 110, 112, 114 and 116, each corresponding to a transitional operating state into a provided extraction control loop. Selection of a particular control loop is made via logic control signals 117, 118, 119 and 120 which originate in the operator's panel 60 and which are fed to the respective set inputs (S) on these flip-flop functional control blocks 110, 112, 114 and 116. Each of the reset inputs (R) is used to cancel a selected control loop and these reset inputs are fed by logic control signals 121, 122, 123 and 124 representing undesired system contingencies such as opening of the main generator breaker 98, failure of sensors 92 or 94, or an indication from the operator's panel 60 to cancel a control loop and its corresponding control mode.

The transition into the local extraction pressure control loop, correspondingly to the first transitional operating state, is now described with reference to FIGS. 2, 3, 4 and 5. In FIG. 2, when selection of the local extraction pressure control loop pushbutton 100 is made via the operator's panel 60, a local extraction pressure loop selection logic control signal 118 is generated in a "high" logical state and, in FIG. 3, is ultimately fed to the set input (S) of the local extraction pressure flip-flop 112 in the extraction control loop selection controller 74. The extraction control loop selection controller 74 operates to generate a corresponding logic control signal, the LOCAL EXTRACTION PRESSURE LOOP IN SERVICE (LEPLIS) logic control signal 76 in a "high" logical state. At the same time, the extraction control loop selection controller 74 generates the other loop selection logic control signals 75, 77 and 78 from the other three flip-flop functional control blocks Remote Extraction Pressure Loop In Servive 110 (REPLIS), Remote Extraction Flow Loop In Service 114 (REFLIS), and Local Extraction Flow Loop In Service 116 (LEFLIS), all in a "low" logical state, since these loops have not been selected. The "high" LEPLIS loop selection logic control signal 76 is fed to the extraction valve pressure transition setpoint controller 86 in FIG. 5, which operates to establish an extraction pressure PID controller 104 as the appropriate controller to achieve a bumpless transfer, as described further herein.

Figure 4:
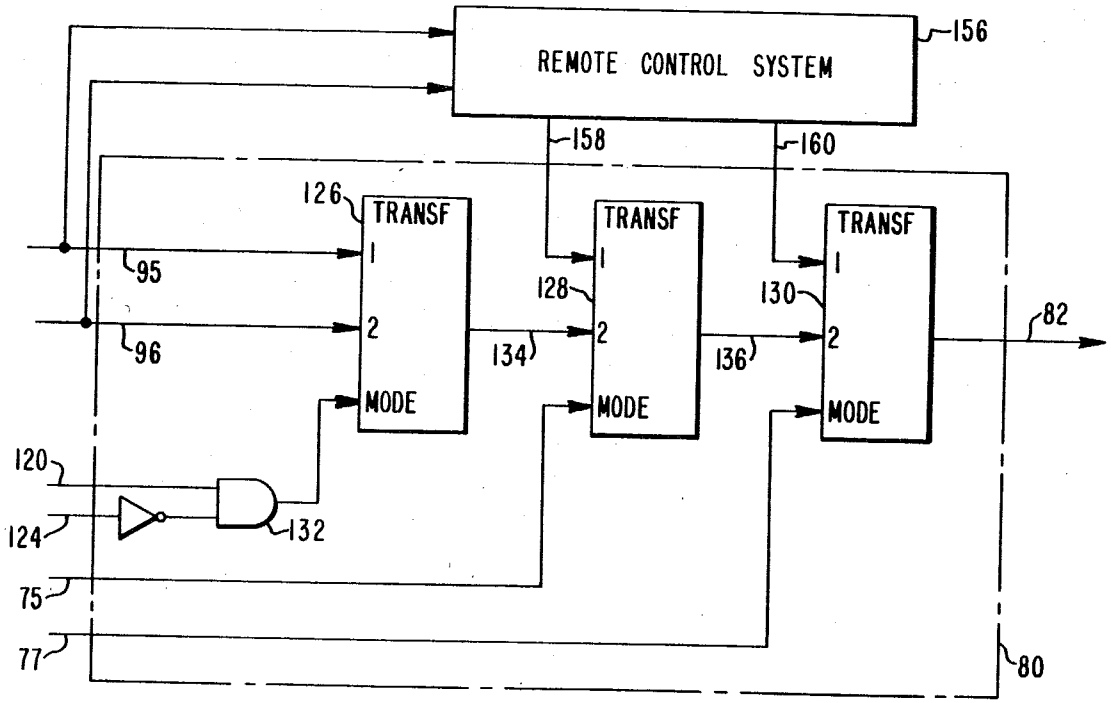

The extraction valve transition reference selection controller 80, shown in FIG. 4, employs three transfer functional control blocks 126, 128 and 130. Each transfer functional control block has an algorithm for transfer of one of two analog inputs. Based on the logical state of a mode signal, each transfer functional control block gates out one of its two analog input signals as its analog output signal. When the mode signal is in a "high" logical state, the signal on input one is gated out as the output signal. When the mode signal is in a "low" logical state, the signal on input two is gated out as the output signal. In this fashion, the extraction valve transition reference selection controller 80 implements the desired control strategy chosen by the operator via the operator's panel 60, as described further herein.

The logic control signal 120 tied to the local extraction flow flip-flop 116 set input (see FIG. 3) originates in the operator's panel 60 and is also fed to the extraction valve transition reference selection controller 80 (see FIG. 4). Because the operator has not selected the local extraction flow control loop at this time, this logic control signal 120 is in a "low" logical state, so that the AND functional control block 132 of the extraction valve transition reference selection controller 80 will set the mode signal on the first transfer functional control block 126 in a "low" logical state so as to gate out the analog input signal on input two as the output. First intermediate signal 134 takes the value of the extraction pressure process variable signal 96 which has been gated out of the first transfer functional control block 126.

The second transfer functional control block 128 gates out the first intermediate signal 134 as its output because the REPLIS logic control signal 75 is in a "low" logical state. This action establishes the second intermediate signal 136 with the same value as that of the first intermediate signal 134, namely, the value of the extraction pressure process variable signal 96. By a similar action, the third transfer functional control block 130 establishes the extraction pressure process variable signal 96 value as the appropriate value of the extraction transition reference signal 82 on a transition into the local extraction pressure control loop. The reason for this is that if the control system is entering into a pressure control mode, to make a bumpless transfer the extraction transition reference signal 82 must be that value of pressure already existing in the extraction cavity 18. That value is represented by the extraction pressure process variable 96 which is used as the extraction transition reference signal 82 in transition. In this fashion, the control system is not being asked to move to a value of extraction pressure different from the value of extraction pressure already existing.

In FIG. 5, the extraction transition reference signal 82 is used in the extraction value pressure transition setpoint controller 86. Because a transition to the pressure control mode is now in progress, the transition-to-pressure logic control signal 136 will be in a "high" logical state. This will set the mode signal on the first transfer functional control block 138 so as to gate out the extraction transition reference signal 82 as the extraction pressure reference signal 102. The delta functional control block 140 operates to compare the extraction pressure reference signal 102 with the extraction pressure process variable signal 96. Because these are the same, as mentioned previously, a zero error signal 108 is fed to the PID functional control block 141. The value of the output of the PID functional control block 142 after transition will be the value of the tracking signal 144 existing just prior to the transition entry into the local extraction pressure control loop.

The tracking signal 144 is derived from the output of the second transfer functional control block 146 in the extraction valve pressure transition setpoint controller 86. Prior to the transition to the local extraction pressure control mode, the transfer functional control block 146 has its mode signal set in a "log" logical state. This is because both the REPLIS and the LEPLIS logic control signals 75 and 76 are in a "low" logical state. Therefore, the transfer functional control block 146 gates out the existing extraction valve setpoint signal 89 as its output signal, so that the tracking signal 144 is equal to the existing extraction valve setpoint signal 89. Upon a transition into the local extraction pressure control loop, the initial value out of the PID functional control block 142 is the value of the tracking signal 144 just prior to the transition, which value was that of the existing extraction valve setpoint signal 89. When the transition occurs, the second transfer functional control block 146 will gate out input one as its output because of the presence of the LEPLIS logic control 76 signal in a "high" logical state. This output signal is the extraction valve pressure setpoint signal 148, and its value is exactly the same as the value of the existing extraction valve setpoint signal 89 prior to the transition.

The extraction valve setpoint selection controller 88 now operates to take the extraction valve pressure setpoint signal 148 on the second input of the transfer functional control block 150, and because both the REFLIS and LEFLIS logic control signals 77 and 78 are in a "low" logical state, this transfer functional control block 150 will gate out the extraction valve pressure setpoint signal 148 as its output so that the extraction valve setpoint signal 89 (EVSP) is now established and fed to the valve controller 90.

Once the transition has passed, the extraction pressure transition setpoint controller 86 will have the first transfer functional control block 138 gate out the extraction pressure reference signal 102 on input two as its output because of the "low" logical state of the transition-to-pressure logic control signal 136.

The extraction pressure reference summer functional control block 152 will allow extraction pressure adjustment by incrementing or decrementing the extraction pressure reference signal 102 in accordance with the incremental extraction pressure reference signal 154 coming from the operator's panel 60 or the remote control system 156 (see FIG. 4) depending on whether a local or a remote control mode is operating. This incremental extraction pressure reference signal 154 is generated by a smoothing function applied to the difference between the desired and actual extraction pressure reference signals.

A transition into the local extraction flow control loop, corresponding to the third transitional operating state, from the base mode of operation in the local extraction pressure control loop, is accomplished in a similar fashion, and the extraction valve flow transition setpoint controller 84 utilizes and generates flow-related signals having their pressure-related counterparts in the extraction valve pressure transition setpoint controller 86.

In FIG. 4, upon a transition into the remote extraction pressure control loop, corresponding to the second transitional operating state, the extraction transition reference signal 82 is established by the remote control system 156 equivalent to remote control pressure reference signal 158. Likewise, upon a transition into the remote extraction flow contol loop, corresponding to the fourth transitional operating state, the extraction transition reference signal 82 is established by the remote control system 156 equivalent to the remote control flow reference signal 160. Since the remote control system 156 has tracked the extraction pressure process variable signal 96 and the extraction flow process variable signal 95, these remote reference signals 158 and 160 are equivalent to the respective process variable signals 96 and 95 upon transition. Otherwise, the transition to a remote control mode is made in a fashion similar to that which has been described.

The local extraction pressure control loop is used as the intermediate mode during a transition between any two other extraction control loops. That is, the local extraction pressure control loop is selected as the first transition in control loops. Once in the local extraction pressure control loop, the transition to any other extraction control loop is accomplished in a similar manner to that described above.

Another method of entry into the local extraction pressure control loop is that method associated with reinsertion of the local extraction pressure control loop upon return from the manual to the automatic sysem.

As noted earlier, the manual system 162 (see FIG. 6) may be in control because of a problem in the automatic system. In the manual control mode, the control loops are operating open-loop and the operator controls the turbine using an analog control system to position the control and extraction valves in accordance with visual process instrumentation readings. During the repair or modification of the automatic system control, the operator may have been implementing an extraction operation in the manual mode. Upon return to the automatic control system, the level of the extraction operation achieved in the manual mode must be preserved in order to avoid a process upset.

With reference to FIG. 3, the present invention provides a reinsertion logic controller 164 to accomplish the reinsertion of the local extraction pressure control loop upon a return from the manual to the automatic control mode. The reinsertion logic controller 164 examines the system operation prior to the return to the automatic mode to determine if an extraction operation was in progress during manual control. The reinsertion logic controller 164 employs logic functional control blocks 166, 168 and 170 to make this determination. In the presence of the appropriate system conditions, the reinsertion logic controller 164 internally generates a reinsertion logic control signal 172 signifying the determination that the local extraction pressure control loop should be reinserted. The reinsertion logic control signal 172 representing this determination is then ultimately fed to the extraction control loop selection controller 74 so as to accomplish a transition to the local extraction pressure control loop as previously described.

The operation of the reinsertion logic controller 164 is now described. Four system operating conditions represented by logic control signals 174, 175, 176 and 177 are fed to the reinsertion logic controller 164 as part of the examination process. These are:

1. "Control was in turbine manual" logic controls signal 174 (WAS MANUAL).
2. "Control is in auto" logic control signal 175 (IS AUTO).
3. "Main generator breaker is closed" logic control signal 176 (BREAKER CLOSED).
4. "Extraction valve position above 99%" logic control signal 177 (EXTRACTION).

When the first two of these logic control signals 174 and 175 are in a "high" logical state, a return to the automatic control system operating mode from the manual mode has just been accomplished. When the BREAKER CLOSED logic control signal 176 is in a "high" logical state, the main generator breaker 98 is closed which, as noted earlier, is a precondition for transition into the local extraction pressure control loop. The last system operating condition necessary for reinsertion of the local extraction pressure control loop is represented by the EXTRACTION logic control signal 177. When in a "low" logical state, this signal 177 indicates that the position of the extraction valve 22 as sensed by the position sensor 178 (see FIG. 5) is below 99% which means an extraction operation is currently in progress.

When the AND logic functional control block 168 in the reinsertion logic controller 164 determines that all of the above necessary system operating conditions are present, reinsertion of the local extraction pressure control loop is called for because an extraction operation was proceeding in the manual mode prior to returning to the automatic mode. The AND logic functional control block 168 then generates a reinsertion logic control signal 172 in a "high" logical state for ultimate use by the local extraction pressure flip-flop 112 in the extraction control loop selection controller 74. A transition into the local extraction pressure control loop then commences as previously described.

In the preferred embodiment, the turbine control system incorporates use of a single-board sixteen-bit microprocessor and an input and output interface having analog and digital conversion capability suitable for use in process environments, such as the MTSC-20 TM turbine control system, sold by the Westinghouse Electric Corporation. This microprocessor-based turbine control system has the inherent advantage of freedom from drift in calibration of components, along with ease of start-up and reduced maintenance requirements.

Figure 6:
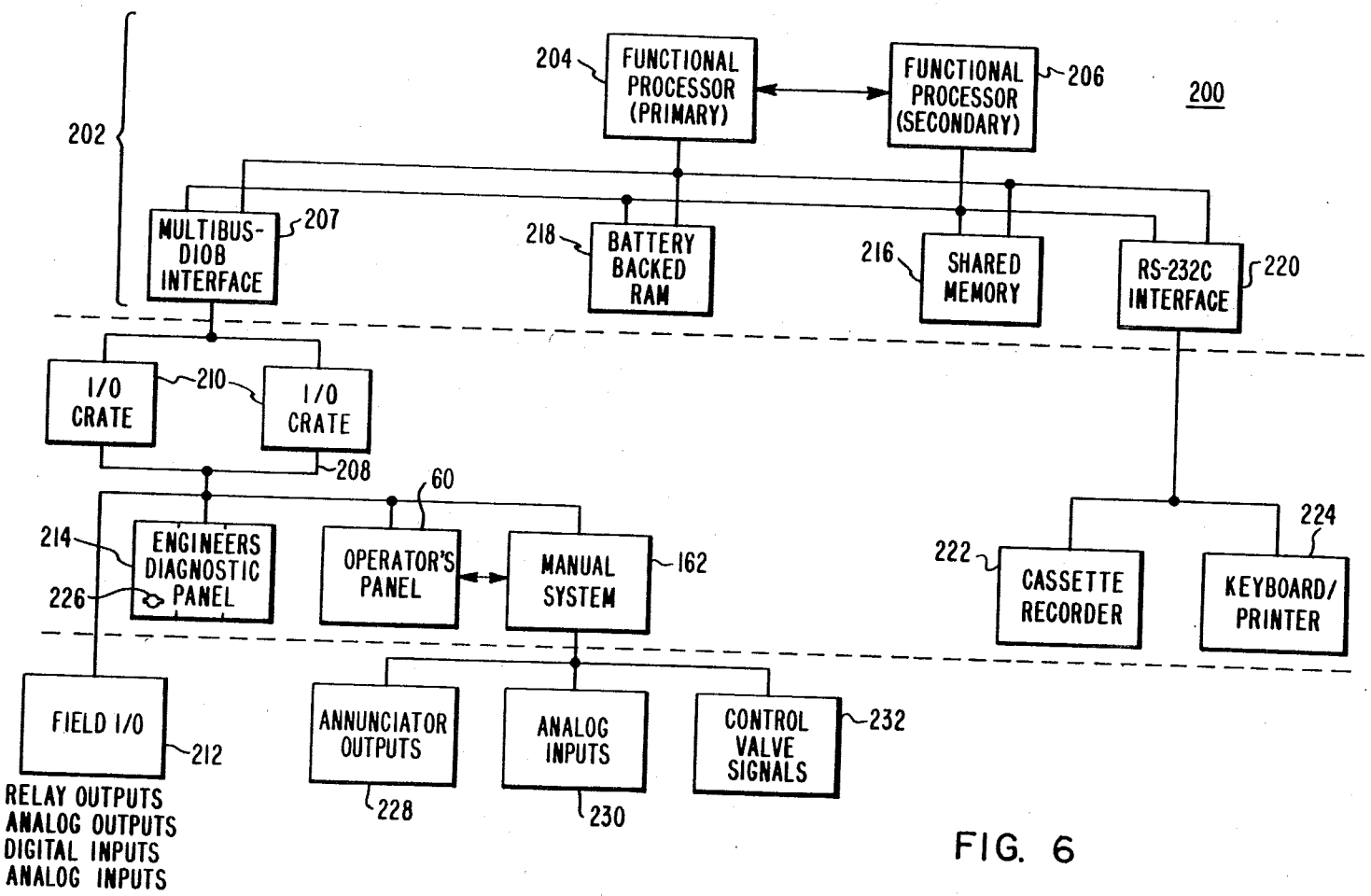
FIG. 6 shows the configuration of a microprocessor-based extraction turbine control system employed in the system of FIGS. 2, 3, 4 and 5.

A typical MTCS-20 TM turbine control system hardware configuration 200 is shown in FIG. 6. The MTCS-20 TM turbine control system uses a standard WDPF TM Multi-bus ® chassis configuration 202 with six printed circuit cards and with Westinghous Q-line I/O, all of which is disclosed in a series of patent applications entitled "Houser et al." all assigned to the present assignee (Ser. Nos. 508,769; 508,770; 508,771; 508,795, 508,951; 509,122; 509,251; and 569,071) and incorporated herein by reference. The pertinent part of these applications is the portion dealing with the "drop overview" as the MTCS-20 TM turbine control system is currently sold by Westinghouse as a stand-alone controller not connected to a data highway. ®Multibus is a registered trademark of Intel Corp. MTCS-20 TM and WDPF TM are trademarks of Westinghouse Electric Corporation and Q-line is a series of printed circuit cards sold by Westinghouse Electric Corporation.

The dual functional processors 204 and 206 give the MTCS-20 TM turbine control system its first level of redundancy. The primary processor 204 is responsible for control loop execution while the normal function of the secondary processor 206 is tuning of the controller, listing the control loop, and displaying control parameters. If the primary processor 204 fails, the secondary processor 206 will automatically begin executing the control loop where the primary processor 204 left off. These two boards also contain duplicate sets of the algorithm library, which is described further herein.

The ®Multibus-DIOB interface card 207 gives the processors access to the I/O system. The Q-Line I/O bus 208 allows mixing of printed circuit point cards of any style anywhere on the bus 208. These cards are located in the I/O crates 210 and can be analog or digital, input or output, in any combination, and can accommodate a large variety of signal types. In the MTCS-20 TM turbine control system 200 these cards provide the interface to the field I/O signal group 212, the engineer's diagnostic panel 214, the operator's panel 60, and the manual system 162.

Two memory components of the MTCS-20 TM turbine control system 200 perform separate functions. A shared-memory board 216 is a 128K AM board providing communication between the two functional processors 204 and 206. A battery-backed RAM board 218 is a 16K memory board on which the software application program for the control loops is stored. It retains its contents for up to 3 hours following a loss of power.

The last card in the ®Multibus chassis 202 is an RS-232C interface board 220 which interfaces a cassette recorder 222 used for permanent storage of the software application program for the control loops, and a keyboard/printer 224 used for entering, changing, and tuning the control loops.

The second level of redundancy in the MTCS-20 TM turbine control system 200 is an analog system, the manual system 162. It protects against failure of the digital system, in which case it would be automatically switched into operation to take control of the turbine. It also permits the plant operator to maintain control, while an engineer changes a digital control loop, by allowing the operator to manually position the turbine control and extraction valves 16 and 22 from the same operator's panel 60 used when the digital system is in control. It also constantly monitors the turbine speed and, in case of an overspeed condition, closes the turbine valves regardless of which system is in control.

The two I/O crates 210 can each hold up to 12 Westinghouse Q-Line I/O point cards. These cards are periodically polled by the software and all process information is retained in registers on the individual point cards. These registers appear as memory locations to the digital system which obtains data through memory accesses and outputs data by memory store commands (memory-mapped I/O). Thus the latest process information is always available to the system and the time response is not degraded by intermediate data handling or buffering.

Three point cards are dedicated to the engineer's diagnostic panel 214. This panel 214 consists of three modules that allow the engineer to monitor the status of the diagnostic alarms, control the mode of the digital system, and display the output of any two system signals. The mode control module in the engineer's diagnostic panel 214 permits an engineer to load a control program, tune algorithms in the loop, or display parameters on the display module. The mode control module provides security from unauthorized use by a two-position keylock switch 226.

The field I/O signal group 212 is made up of the I/O signals from the field I/O hardware which includes field instrumentation such as feedback transducers 92 and 94 in FIG. 5, and field actuators such as position sensor 178 that are located on the extraction turbine and the associated steam flow piping. The annunciator output signal grouping 228 indicates system abnormalities and is typically tied to multiple annunciator display panels in the control room or elsewhere. The analog input signal grouping 230 is segregated and tied directly to the manual system 162 so that in the event of a loss of the digital control system, essential signals for manual control are available. The control valve signal grouping 232 includes the valve servo position loop signals to and from the servo actuators which tie into the valve controller 90 (see FIG. 5).

The software application programs for the control loops of FIGS. 3, 4 and 5 are furnished in the MTCS-20 TM microprocessor in the form of software application program algorithms based on the use of modular functional control blocks. The functional control blocks are designed to replace tasks which a typical analog or digital control loop needs to perform. The set of available functional control blocks forms the algorithm library and includes arithmetic blocks, limit blocks, control blocks, I/O blocks, auto/manual blocks, (for manual setpoint entry and control), and miscellaneous blocks. The miscellaneous category includes functions for generating analog and digital values, generating polynomial functions, gating one of two analog signals based on the logic state of a mode signal, time delays, etc.

The MTCS-20 TM turbine control system is designed for interactive entry of functional control blocks on a line-by-line basis, to form the application program. Each line of the application program consists of the functional control block number, the algorithm name (from the algorithm library) corresponding to that functional control block, and each of the parameter locations forming the arguments or inputs to that algorithm. Each functional control block chosen by the operator and listed on a line of the application program is task-specific, with only one output, which provides a high degree of flexibility and ease of changing. A translator handles the functional control blocks in the order in which they were entered by the operator. It translates the algorithm name of the functional control block, which the operator understands, into a series of data blocks in the pre-specified operator-chosen order so that each data block has a block number, algorithm number, parameter location, paratmeter location, paramater location, etc. for as many parameters as that particular algorithm requires. The translator also checks the syntax of the operator-entered data, and thereby preprocesses the application program for block-sequential, run-time interpretation by an interpreter. The interpreter executes the application program in the functional processor and works on the series of data blocks which the translator has created. The interpreter calls the algorithms in the order in which they were entered, corresponding to the lines of the application program. The interpreter also routes the answers generated by each algorithm to the correct location in memory for use by later blocks in the application program. The use of a run-time interpreter eliminates compiling, thereby saving time and increasing the flexibility and ease of programming. The completion cycle time of the control loop is user-selectable.

Appendix A contains a preferred algorithm library set for use with the present invention. Appendix B contains the preferred application program listing for use with the present invention. Appendix C contains an address label conversion table for locating the DIOB address of digital and analog input and output labels used in the preferred application program listing. Appendix D contains a set of Q-line card types used for specific algorithms in the preferred algorithm library.

The following page is Appendix page -A1-

ABSVAL

ABSOLUTE VALUE OF AN INPUT

OPERATION

The output is the absolute value of the input.

SYMBOL

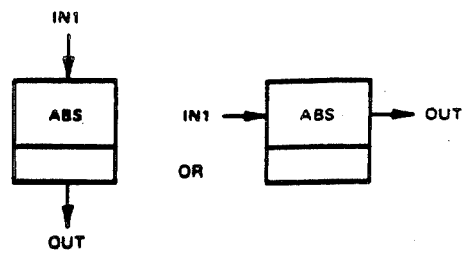

VARIABLES

| Variable | Description |
|---|---|
| IN1 | Analog value |
| OUT | Analog value |

TUNING CONSTANTS

No tuning constants are used in this algorithm.

MATHEMATICS

OUT = ABS(IN1)

PROGRAMMING LANGUAGE

This algorithm is implemented using the PASCAL programming language.

AND2

LOGICAL AND GATE WITH TWO INPUTS

OPERATION

The output equals the logical AND of two inputs; that is, both inputs must be TRUE for the output to be TRUE.

SYMBOL

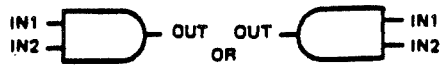

VARIABLES

| Variable | Description |
|---|---|
| IN1 | Digital signal |
| IN2 | Digital signal |
| OUT | Digital signal |

TUNING CONSTANTS

No tuning constants are used in this algorithm.

MATHEMATICS

OUT = IN1 AND IN2

PROGRAMMING LANGUAGE

This algorithm is implemented using the Assembly programming language.

ANIN

INPUT ANALOG VALUE FROM DIOB

OPERATION

Out equals the value of the specified card type at the specified DIOB address which is indicated by an analog address label.

VARIABLES

| Variable | Description |
|---|---|
| A-ADDR | Analog input address label (refer to Appendix C ) |
| CARDTP | Card type (refer to appendix D) |
| OUT | Analog value |

TUNING CONSTANTS

No tuning constants are used in this algorithm.

MATHEMATICS

No mathematics described this algorithm.

PROGRAMMING LANGUAGE

This algorithm is implemented using the PASCAL programming language.

ANOUT

OUTPUT ANALOG VALUE TO DIOB

OPERATION

Input analog value if output to specified card type at specified CIOB address which is indicated by analog address lable.

VARIABLES

| Variable | Description |
|---|---|
| IN1 | Analog Value |
| A-ADDR | Analog Output Address Label (refer to Appendix C ) |
| CARDTP | Card Type (refer to Appendix D) |

TUNING CONSTANTS

No tuning constants are used in this algorithm.

MATHEMATICS

No mathematics describe this algorithm.

PROGRAMMING LANGUAGE

This algorithm is implemented using the PASCAL programming language.

AND8

LOGICAL AND GATE WITH EIGHT INPUTS

OPERATION

The output equals the logical AND of eight inputs; i.e., all eight inputs must be TRUE for the output to be TRUE. If less than eight inputs are present, one or more of the existing signal names may be repeated until all eight inputs have an assigned name.

SYMBOL

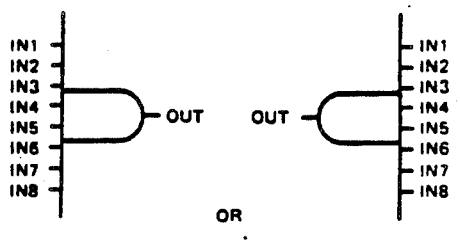

VARIABLES

| Variable | Description |
|---|---|
| IN1 | Digital signal |
| IN2 | Digital signal |
| IN3 | Digital signal |
| IN4 | Digital signal |
| IN5 | Digital signal |
| IN6 | Digital signal |
| IN7 | Digital signal |
| IN8 | Digital signal |
| OUT | Digital signal |

TUNING CONSTANTS

No tuning constants are used in this algorithm.

MATHEMATICS

OUT = IN1 AND IN2 AND IN3 AND IN4 AND IN5 AND IN6 AND IN7 AND IN8

PROGRAMMING LANGUAGE

This algorithm is implemented using the Assembly programming language.

AVG4W

AVERAGE OF FOUR WEIGHTED INPUTS

OPERATION

Output equals the average of four weighted inputs. Each input is independently gained. The sum is then divided by four. If averaging of more or less than four inputs is desired, use algorithm AVGNW or AVG2W..

VARIABLES

| Variable | Description |
|---|---|
| IN1 | Analog value |
| IN2 | Analog value |
| IN3 | Analog value |
| IN4 | Analog value |
| OUT | Analog value |

TUNING CONSTANTS

| Tuning Constant | Mnemonic | Description |
|---|---|---|
| R1 | WT1 | Weighting factor or gain on IN1 |
| R2 | WT2 | Weighting factor or gain on IN2 |
| R3 | WT3 | Weighting factor or gain on IN3 |
| R4 | WT4 | Weighting factor or gain on IN4 |

Note (Weighting factor or gain can be + or −)

SYMBOL

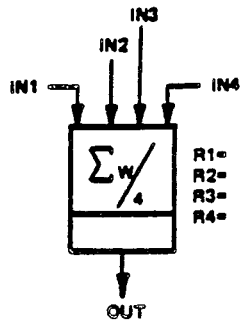

MATHEMATICS $$OUT = (WT1 \times IN1 + WT2 \times IN2 + WT3 \times IN3 + WT4 \times IN4)/4$$

PROGRAMMING LANGUAGE

This algorithm is implemented using the PASCAL programming language.

AVALGEN

*(Analog Value Generator)*

Description

The output is the analog value stored in the tuning constant (VALU). This value is a set point or bias to other algorithms.

Programming Language

PASCAL

Function

OUT = VALU

Symbol

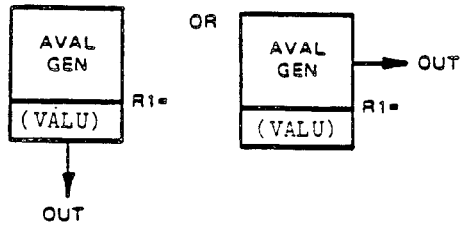

DBDLTA

DIFFERENCE BETWEEN TWO INPUTS WITH DEADBAND

OPERATION

If the absolute value of the difference of two inputs is less than or equal to the deadband, the output equals zero. Otherwise, the output equals the difference plus the deadband where the difference is less than zero, or the output equals the difference minus the deadband where the difference is greater than zero. The difference equals IN1 − IN2.

SYMBOL

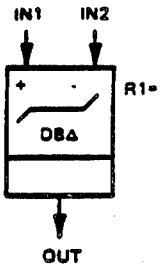

VARIABLES

| Variable | Description |
|---|---|
| IN1 | Analog value |
| IN2 | Analog value |
| OUT | Analog value |

TUNING CONSTANTS

| Tuning Constant | Mnemonic | Description |
|---|---|---|
| R1 | DBAN | Deadband |

MATHEMATICS

```
TEMP = IN1 - IN2
IF ABS (TEMP) ≤ DBAN
THEN OUT = 0.0
ELSE
IF TEMP < 0.0
THEN OUT = TEMP + DBAN
ELSE OUT = TEMP - DBAN
```

where:

TEMP = local temporary Real variable

PROGRAMMING LANGUAGE

This algorithm is implemented using the PASCAL programming language.

DBEQUALS

DEVIATION MONITOR BETWEEN TWO VARIABLE INPUTS

OPERATION

This high/low comparator monitors two analog input values. If the absolute value of the difference between the signals exceeds the deadband value, the digital output is set TRUE; otherwise, the output is false.

SYMBOL

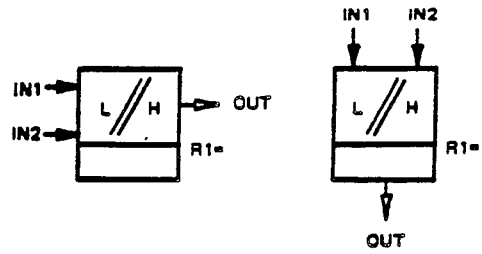

VARIABLES

| Variable | Description |
|---|---|
| IN1 | Analog value |
| IN2 | Analog value |
| OUT | Digital output |

TUNING CONSTANTS

| Tuning Constant | Mnemonic | Description |
|---|---|---|
| R1 | DBAN | Deadband |

MATHEMATICS

TEMP = IN1 − IN2
IF ABS (TEMP) < DBAN
THEN OUT = FALSE
ELSE OUT = TRUE where:

TEMP = local temporary Real variable

PROGRAMMING LANGUAGE

This algorithm is implemented using the PASCAL programming language.

DGIN

INPUT DIGITAL SIGNAL FROM DIOB

OPERATION

Out equals the value of a digital signal at a specified DIOB address indicated by a digital address label.

VARIABLES

| Variable | Description |
|---|---|
| D-ADDR | Digital Address Label (refer to Appendix C ) |
| OUT | Digital Signal |

TUNING CONSTANTS

No tuning constants are used in this algorithm.

MATHEMATICS

No mathematics describe this algorithm.

PROGRAMMING LANGUAGE

This algorithm is implemented using the PASCAL programming language.

DGOUT

OUTPUT DIGITAL SIGNAL TO DIOB

OPERATION

Input digital signal output to specified DIOB address which is indicated by a digital address label.

VARIABLES

| Variable | Description |
|---|---|
| IN1 | Digital Signal |
| D-ADDR | Digital Address Label (refer to Appendix C) |

TUNING CONSTANTS

No tuning constants are used in this algorithm.

MATHEMATICS

No mathematics describe this algorithm.

PROGRAMMING LANGUAGE

This algorithm is implemented using the PASCAL programming language.

DISPLAYA

DISPLAY ANALOG VALUE ON BAR GRAPH A

OPERATION

The input analog value is displayed at the operator's panel on Bar Graph A

VARIABLES

| Variable | Description |
|---|---|
| IN1 | Analog Value |
| OUT | Displayed on Bar Graph A |

TUNING CONSTANTS

| Tuning Constant | Mnemonic | Description |
|---|---|---|
| IN1 | | |

MATHEMATICS

No mathematics describe this algorithm.

PROGRAMMING LANGUAGE

This algorithm is implemented using the PASCAL programming language.

DISPLAYB

DISPLAY ANALOG VALUE ON BAR GRAPH B

OPERATION

The input analog value is displayed at the operator's panel on Bar Graph B

VARIABLES

| Variable | Description |
|---|---|
| IN | Analog Value |
| OUT | Displayed on Bar Graph B |

TUNING CONSTANTS

| Tuning Constant | Mnemonic | Description |
|---|---|---|
| IN1 | | |

MATHEMATICS

No mathematics describe this algorithm.

PROGRAMMING LANGUAGE

This algorithm is implemented using the PASCAL programming language.

DVALGEN

DIGITAL VALUE GENERATOR

OPERATION

The output is the digital value stored in the tuning constant VALU. This value can be used to force any digital input to any algorithm to either a TRUE or FALSE state that will remain fixed unless changed by the MMI tuning function.

SYMBOL

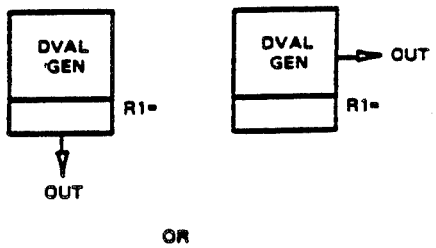

VARIABLES

| Variable | Description |
|---|---|
| OUT | Digital output value |

TUNING CONSTANTS

| Tuning Constant | Mnemonic | Description |
|---|---|---|
| R1 | VALU | Digital value (either TRUE or FALSE) |

MATHEMATICS

OUT = VALU

PROGRAMMING LANGUAGE

This algorithm is implemented using the PASCAL programming language.

GAINBI

GAIN AND BIAS AN INPUT

OPERATION

The output is equal to the input times the gain (GAIN) plus a bias (BIAS).

SYMBOL

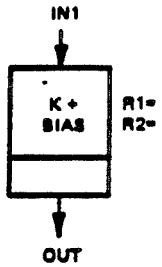

VARIABLES

| Variable | Description |
|---|---|
| IN1 | Analog value |
| OUT | Analog value |

TUNING CONSTANTS

| Tuning Constant | Mnemonic | Description |
|---|---|---|
| R1 | GAIN | Gain |
| R2 | BIAS | Bias |

Note

1. Gain or Bias can be + or −.
2. If R2 (Bias) is not specified, it will be automatically set equal to zero.

MATHEMATICS

OUT = (IN1 × GAIN) + BIAS

PROGRAMMING LANGUAGE

This algorithm is implemented using the PASCAL programming language.

HDFAIL

HARDWARE STATUS OF DIGITAL SIGNAL

OPERATION

Output signal is set if hardware status of input signal is bad; else reset.

VARIABLES

| Variable | Description |
|---|---|
| IN1 | Digital Signal |
| OUT | Digital Signal |

TUNING CONSTANTS

No tuning constants are used in this algorithm.

MATHEMATICS

No mathematics describe this algorithm.

PROGRAMMING LANGUAGE

This algorithm is implemented using the Assembly programming language.

HILMT

HIGH LIMITER WITH FIXED LIMIT

OPERATION

The output is equal to the input value IN1 or the high limit value, whichever is lower.

SYMBOL

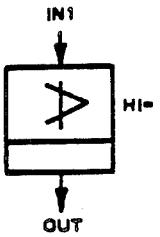

VARIABLES

| Variable | Description |
|---|---|
| IN1 | Analog value |
| OUT | Analog value |

TUNING CONSTANTS

| Tuning Constant | Mnemonic | Description |
|---|---|---|
| HI | HILM | High limit value |

MATHEMATICS

IF IN1 ≤ HILM
THEN OUT = IN1
ELSE OUT = HILM

PROGRAMMING LANGUAGE

This algorithm is implemented using the PASCAL programming language.

HISIGMTV

HIGH SIGNAL MONITOR WITH RESET DEADBAND AND A VARIABLE LIMIT

OPERATION

If the input value IN1 exceeds the variable setpoint input STPT, the digital flag is set TRUE. To clear the flag, the input value must be less than the setpoint input STPT minus the deadband.

SYMBOL

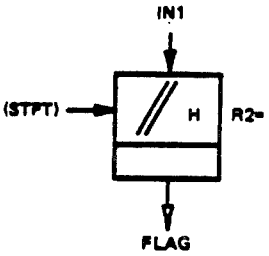

VARIABLES

| Variable | Description |
|---|---|
| IN1 | Analog value |
| STPT | Analog variable setpoint value |
| FLAG | Digital output signal |

TUNING CONSTANTS

| Tuning Constant | Mnemonic | Description |
|---|---|---|
| R2 | DBAN | Deadband in reset direction |

MATHEMATICS

IF FLAG = FALSE
AND IF IN1 > STPT
THEN FLAG = TRUE
ELSE
IF FLAG = TRUE
AND IF IN1 < (STPT − DBAN)
THEN FLAG = FALSE
ELSE FLAG = TRUE

PROGRAMMING LANGUAGE

This algorithm is implemented using the PASCAL programming language.

IBCDOUT (Outputs Inverted BCD Digits from the Functional Processor to the DIOB)

Description

This algorithm reads a real value from input IN1, converts it to binary-coded-decimal (BCD), inverts the BCD, and outputs a number of digits to the Distributed I/O Bus (DIOB). The user must specify the offset of the value in the DIOB, the number of BCD digits to write, and the bit position where the writing is to begin.

Symbol

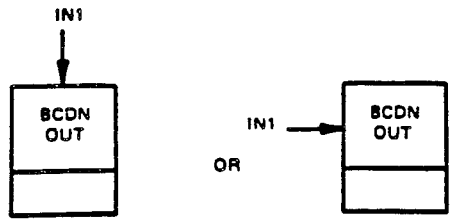

Programming Language

Assembly

LOLMT

LOW LIMITER WITH FIXED LIMIT

OPERATION

The output is equal to the input value IN1 or the low limit value, whichever is higher.

SYMBOL

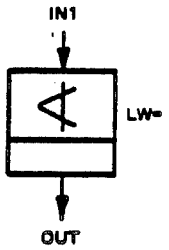

VARIABLES

| Variable | Description |
|---|---|
| IN1 | Analog value |
| OUT | Analog value |

TUNING CONSTANTS

| Tuning Constant | Mnemonic | Description |
|---|---|---|
| LW | LOLM | Low limit value |

MATHEMATICS

IF IN1 ≥ LOLM
THEN OUT = IN1
ELSE OUT = LOLM

PROGRAMMING LANGUAGE

This algorithm is implemented using the PASCAL programming language.

LOSEL4

LOW SIGNAL SELECTOR WITH FOUR INPUTS

OPERATION

The output equals the lowest of four analog input values. If less than four input signals are present, one or more of the existing signal names must be repeated until all four inputs have an assigned name.

SYMBOL

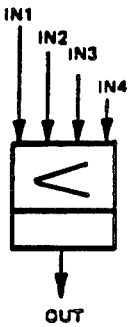

VARIABLES

| Variable | Description |
|---|---|
| IN1 | Analog value |
| IN2 | Analog value |
| IN3 | Analog value |
| IN4 | Analog value |
| OUT | Analog value |

TUNING CONSTANTS

No tuning constants are used in this algorithm.

MATHEMATICS

No mathematics describe this algorithm.

PROGRAMMING LANGUAGE

This algorithm is implemented using the PASCAL programming language.

LOSIGMTV

LOW SIGNAL MONITOR WITH RESET DEADBAND AND A VARIABLE LIMIT

OPERATION

If the input value IN1 goes below the variable setpoint input STPT, the digital flag is set TRUE. To clear the flag, the input value must be greater than the setpoint input STPT plus the deadband.

SYMBOL

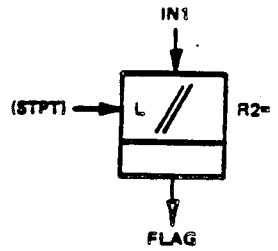

VARIABLES

| Variable | Description |
|---|---|
| IN1 | Analog value |
| STPT | Analog variable setpoint value |
| FLAG | Digital output signal |

TUNING CONSTANTS

| Tuning Constant | Mnemonic | Description |
|---|---|---|
| R2 | DBAN | Deadband in reset direction |

MATHEMATICS

```
IF FLAG = FALSE
AND IF IN1 < STPT
THEN FLAG = TRUE
ELSE
IF FLAG = TRUE
AND IF IN1 > (STPT + DBAN)
THEN FLAG = FALSE
ELSE FLAG = TRUE
```

PROGRAMMING LANGUAGE

This algorithm is implemented using the PASCAL programming language.

MEDSEL

MEDIUM VALUE SELECTOR

OPERATION

Output is equal to the medium value of three analog input values.

SYMBOL

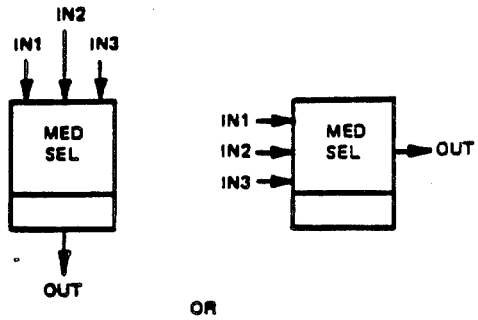

VARIABLES

| Variable | Description |
|---|---|
| IN1 | Analog value |
| IN2 | Analog value |
| IN3 | Analog value |
| OUT | Analog value |

TUNING CONSTANTS

No tuning constants are used in this algorithm.

MATHEMATICS

OUT = IN1, IF IN2 ≤ IN1 ≤ IN3 OR
IN3 ≤ IN1 ≤ IN2

OUT = IN2, IF IN1 ≤ IN2 ≤ IN3 OR
IN3 ≤ IN2 ≤ IN1

OUT = IN3, IF IN1 ≤ IN3 ≤ IN2 OR
IN2 ≤ IN3 ≤ IN1

PROGRAMMING LANGUAGE

This algorithm is implemented using the PASCAL programming language.

MULTDIV

MULTIPLIER PLUS DIVIDER

OPERATION

Output is equal to the first two inputs multiplied and divided by the third input.

VARIABLES

| Variable | Description |
|---|---|
| IN1 | Analog Value |
| IN2 | Analog Value |
| IN3 | Analog Value |
| OUT | Analog Value |

TUNING CONSTANTS

No tuning constants are used in this algorithm.

MATHEMATICS

OUT: = (IN1 * IN2) / IN3

PROGRAMMING LANGUAGE

This algorithm is implemented using the PASCAL programming language.

NOTIN

LOGICAL NOT GATE

OPERATION

Output is the logical "NOT" of the input; that is:

IF IN1 = TRUE THEN OUT = FALSE
IF IN1 = FALSE THEN OUT = TRUE

SYMBOL

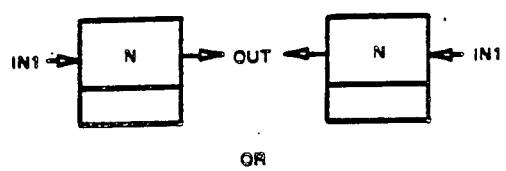

VARIABLES

| Variable | Description |
|---|---|
| IN1 | Digital signal |
| OUT | Digital signal |

TUNING CONSTANTS

No tuning constants are used in this algorithm.

MATHEMATICS

OUT = NOT IN1

PROGRAMMING LANGUAGE

This algorithm is implemented using the Assembly programming language.

OR2

LOGICAL OR GATE WITH TWO INPUTS

OPERATION

The output equals the logical OR of two inputs; i.e., at least one input must be TRUE for the output to be TRUE.

SYMBOL

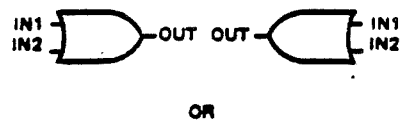

VARIABLES

| Variable | Description |
|---|---|
| IN1 | Digital signal |
| IN2 | Digital signal |
| OUT | Digital signal |

TUNING CONSTANTS

No tuning constants are used in this algorithm.

MATHEMATICS

OUT = IN1 OR IN2

PROGRAMMING LANGUAGE

This algorithm is implemented using the Assembly programming language.

OR8

LOGICAL OR GATE WITH EIGHT INPUTS

OPERATION

The output equals the logical OR of eight inputs; i.e., at least one input must be TRUE for the output to be TRUE.

SYMBOL

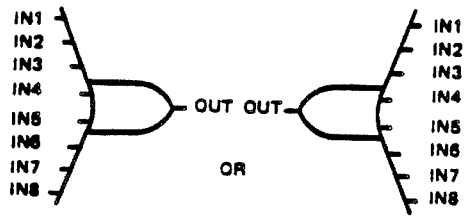

VARIABLES

| Variable | Description |
|---|---|
| IN1 | Digital signal |
| IN2 | Digital signal |
| IN3 | Digital signal |
| IN4 | Digital signal |
| IN5 | Digital signal |
| IN6 | Digital signal |
| IN7 | Digital signal |
| IN8 | Digital signal |
| OUT | Digital signal |

TUNING CONSTANTS

No tuning constants are used in this algorithm.

MATHEMATICS

OUT = IN1 OR IN2 OR IN3 OR IN4 OR IN5
OR IN6 OR IN7 OR IN8

PROGRAMMING LANGUAGE

This algorithm is implemented using the Assembly programming language.

PIDVLIM

PROPORTIONAL + INTEGRAL + DERIVATIVE CONTROLLER WITH VARIABLE LIMITS

OPERATION

This nonlinear PID Controller has two modes. When in the Tracking mode (TMOD = TRUE), the output equals the tracking input (TRIN). When TMOD = FALSE the output value is a function of the old output, input value, gain, reset and derivative. The output in this latter mode is constant only when the input = 0. It is also high and low limited by variable limit values in both modes.

VARIABLES

| Variable | Description |
|---|---|
| IN1 | Analog value |
| OUT | Analog value |
| TRIN | Analog input; track output to this value |
| LOLM | Low limit value analog input |
| HILM | High limit value analog input |
| TMOD | Tracking request digital input |

TUNING CONSTANTS

| Tuning Constant | Mnemonic | Description |
|---|---|---|
| GN | GAIN | Gain |
| RE | RSET | Reset |
| RA | RATE | Rate |

Note (Gain can be + or −)

SYMBOL

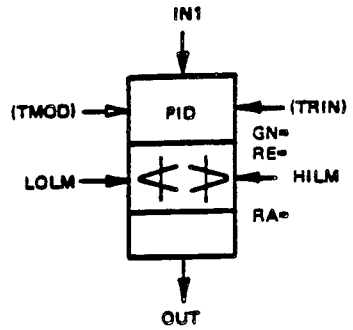

MATHEMATICS

IF TMOD = TRUE
THEN TEMP = TRIN
ELSE
K1 = GAIN [(TS)/(2 × RSET) + 1.0]
K2 = GAIN [(TS)/(2 × RSET) − 1.0]
K3 = GAIN [(2 × RATE)/(2 × RATE) + TS]
K4 = (2 × RATE − TS)/(2 × RATE + TS)
P1 = K1 × IN1 + K2 × OLDIN + PROPOLD
D1 = K3 × (IN1 − OLDIN) + K4 × DERVOLD
TEMP = P1 + D1
IF TEMP ≥ HILM
THEN OUT = HILM
ELSE IF TEMP ≤ LOLM
THEN OUT = LOLM
ELSE OUT = TEMP where:

K1, K2, K3, K4, OLDIN, PROPOLD, DERVOLD = local retained Real variables
TEMP = local temporary Real variable
TS = sampling time (DDC program loop time)

PROGRAMMING LANGUAGE

This algorithm is implemented using the PASCAL programming language.

SRFLOP

S-R TYPE FLIP-FLOP WITH 1 OUTPUT

OPERATION

SRFLOP is a memory device in which the output state is defined by the truth table below.

VARIABLES

| Variable | Description |
|---|---|
| SET | Digital Signal |
| RSET | Digital Signal |
| OUT | Digital Signal |

TUNING CONSTANTS

No tuning constants are used in this algorithm.

MATHEMATICS

TRUTH TABLE

| SET | RESET | OUT |
|---|---|---|
| 0 | 0 | X |
| 0 | 1 | 0 |
| 1 | 0 | 1 |
| 1 | 1 | 0 |

Where X output remains in previous state.

PROGRAMMING LANGUAGE

This algorithm is implemented using the Assembly programming language.

SUM2

SUM OF TWO INPUTS

OPERATION

The output equals the sum of two inputs.

SYMBOL

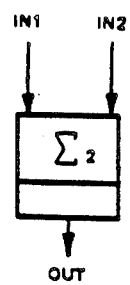

VARIABLES

| Variable | Description |
|---|---|
| IN1 | Analog value |
| IN2 | Analog value |
| OUT | Analog value |

TUNING CONSTANTS

No tuning constants are used in this algorithm.

MATHEMATICS

OUT = IN1 + IN2

PROGRAMMING LANGUAGE

This algorithm is implemented using the PASCAL programming language.

SUM4W

SUM OF FOUR WEIGHTED INPUTS

OPERATION

The output equals the sum of four inputs, each of which has a gain term. The gain terms are used to scale inputs so that the output range is the same as the input range or to weight the various inputs differently with respect to each other. If less than four input signals are present, one or more existing signals must be repeated until all four inputs have an assigned name. Adjust weighting factors accordingly.

SYMBOL

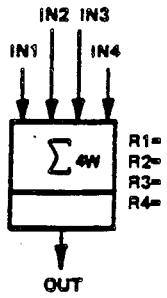

VARIABLES

| Variable | Description |
|---|---|
| IN1 | Analog value |
| IN2 | Analog value |
| IN3 | Analog value |
| IN4 | Analog value |
| OUT | Analog value |

TUNING CONSTANTS

| Tuning Constant | Mnemonic | Description |
|---|---|---|
| R1 | WT1 | Weighting factor or gain on input IN1 |
| R2 | WT2 | Weighting factor or gain on input IN2 |
| R3 | WT3 | Weighting factor or gain on input IN3 |
| R4 | WT4 | Weighting factor or gain on input IN4 |

Note (Weighting factor or gain can be + or −)

TIMEDEL

TIME DELAY FOR A LOGICAL INPUT

OPERATION

The output becomes a logical TRUE signal "X" amount of time after the input changes state from FALSE to TRUE. The "X" is equal to the delay time. The input must remain TRUE for a time interval equal to or greater than the delay time for the output to go TRUE. There is no delay in the output changing from TRUE to FALSE when the input changes from TRUE to FALSE.

SYMBOL

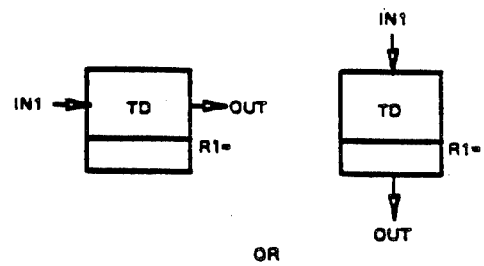

VARIABLES

| Variable | Description |
|---|---|
| IN1 | Digital signal |
| OUT | Digital signal |

TUNING CONSTANTS

| Tuning Constant | Mnemonic | Description |
|---|---|---|
| R1 | TIME | Delay time |

MATHEMATICS

No mathematics describe this algorithm.

PROGRAMMING LANGUAGE

This algorithm is implemented using the RASCAL programming language.

TRACK

TRACKING BUFFER

OPERATION

In the normal mode (TMOD = FALSE), the output is equal to the analog input INSP. In the Tracking mode (TMOD = TRUE), the output is equal to the analog tracking input TRIN. During transitions from Track to normal mode, the output is ramped from the TRIN value to the INSP value at a rate in units per second specified by the decay rate.

SYMBOL

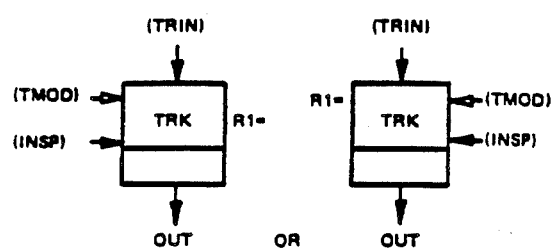

VARIABLES

| Variable | Description |
|---|---|
| INSP | Analog input that is usually passed through to output |
| TRIN | Analog value; Tracking input. (Track output to this value when TMOD = TRUE) |
| OUT | Analog output |
| TMOD | Digital signal; command to Track when signal TRUE |

TUNING CONSTANTS

| Tuning Constant | Mnemonic | Description |
|---|---|---|
| R1 | DCAY | Decay rate |

MATHEMATICS

```
IF TMOD = TRUE
THEN OUT = TRIN
ELSE
STEP = DCAY × TS
TDIF = INSP − TRIN
IF ABS(TDIF) < STEP
THEN OUT = INSP
ELSE IF TDIF < 0.0
THEN OUT = OLDOUT − STEP
ELSE OUT = OLDOUT + STEP
```

where:

OLDOUT = local retained variable
STEP, TDIF = local temporary variables

PROGRAMMING LANGUAGE

This algorithm is implemented using the PASCAL programming language.

TRANSF

TRANSFER BETWEEN TWO ANALOG INPUTS

OPERATION

The output is equal to one of two analog inputs. If the digital command FLAG = TRUE, then the OUTPUT = IN1. If FLAG = FALSE, the OUTPUT = IN2.

VARIABLES

| Variable | Description |
|---|---|
| IN1 | Analog value |
| IN2 | Analog value |
| OUT | Analog value |
| FLAG | Digital input signal; transfers IN1 to the output when FLAG = TRUE |

TUNING CONSTANTS

No tuning constants are used in this algorithm.

MATHEMATICS

No mathematics describe this algorithm.

PROGRAMMING LANGUAGE

This algorithm is implemented using the Assembly programming language.

SYMBOL

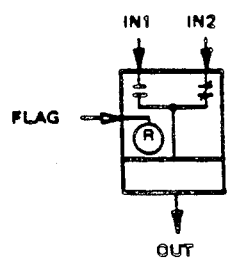

XOR2

EXCLUSIVE OR OF TWO INPUTS

OPERATION

The output is the logical exclusive "OR" of the two inputs; i.e., if *either* IN1 *or* IN2 is TRUE, output is TRUE. Otherwise, output is FALSE.

SYMBOL

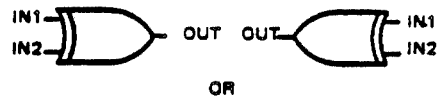

VARIABLES

| Variable | Description |
|---|---|
| IN1 | Digital signal |
| IN2 | Digital signal |
| OUT | Digital signal |

TUNING CONSTANTS

No tuning constants are used in this algorithm.

MATHEMATICS

IF IN1 AND IN2 = TRUE
THEN OUT = FALSE
ELSE OUT = IN1 OR IN2

PROGRAMMING LANGUAGE

This algorithm is implemented using the Assembly programming language.

```
ENTER: LOAD,GO,TUNE,LIST,TAPE,MSG
>LIST
*** MTCS-20tm LOOPTIME :   0.6000
*** NO DATA HIWAY
*** TOTAL BLOCKS USED :      862
BLOCK ALGNAME  PARAMETERS
----- -------  --------------------
    1: AVALGEN  1.0000
    2: AVALGEN  2.0000
    5: AVALGEN  5.0000
    6: AVALGEN  6.0000
   10: AVALGEN  10.000
   25: AVALGEN  25.000
   30: AVALGEN  30.000
   60: AVALGEN  60.000
   80: AVALGEN  80.000
   98: AVALGEN  98.000
   99: AVALGEN  99.000
  100: AVALGEN  100.00
  101: ANIN          A1,     15
  102: ANIN          A2,     15
  103: ANIN          A3,     15
  104: ANIN          A4,     15
```

```
105: ANIN        A5,     15
107: ANIN        A7,     15
108: ANIN        A8,     15
109: ANIN        A9,     15
110: ANIN       A10,     15
111: ANIN       A11,     15
113: ANIN       A13,     15
114: ANIN       A14,     15
115: ANIN       A15,     15
121: ANIN       A21,     16
122: ANIN       A22,     16
123: ANIN       A23,     16
202: DBEQUALS  B114, B3340,2.0000
380: TRANSF   B3820,     B1, B3800
401: DGIN        D1
402: DGIN        D2
403: DGIN        D3
404: DGIN        D4
405: DGIN        D5
406: DGIN        D6
407: DGIN        D7
408: DGIN        D8
409: DGIN        D9
410: DGIN       D10
411: DGIN       D11
412: DGIN       D12
413: DGIN       D13
414: DGIN       D14
415: DGIN       D15
416: DGIN       D16
417: DGIN       D17
418: DGIN       D18
419: DGIN       D19
420: DGIN       D20
421: DGIN       D21
422: DGIN       D22
423: DGIN       D23
424: DGIN       D24
425: DGIN       D25
426: DGIN       D26
427: DGIN       D27
431: DGIN       D31
432: DGIN       D32
433: DGIN       D33
434: DGIN       D34
435: DGIN       D35
436: DGIN       D36
437: DGIN       D37
438: DGIN       D38
439: DGIN       D39
440: DGIN       D40
441: DGIN       D41
442: DGIN       D42
443: DGIN       D43
444: DGIN       D44
800: AND2      B416, B8940
801: AND2      B417, B8941
802: AND2      B418, B8942
803: AND2      B422, B8943
804: AND2      B423, B8944
805: AND2      B424, B8945
806: AND2      B427, B8946
807: AND2      B443, B8947
```

```
 808: AND2        B433, B8948
 809: AND2        B434, B8949
 810: AND2        B435, B8950
 811: AND2        B436, B8951
 812: AND2        B439, B8952
 813: AND2        B440, B8953
1000: HDFAIL     . B401
1001: AVALGEN   0.0000
1002: AVALGEN   -0.500
1003: GAINBI      B102,2.5000,-25.00
1004: GAINBI      B101,2.5000,-25.00
1005: GAINBI      B103,2.5000,-25.00
1006: GAINBI      B104,2.5000,-25.00
1007: GAINBI      B105,1.2500,-25.00
1008: GAINBI      B110,-1.000,100.00
1009: AVALGEN   -5.000
1010: NOTIN       B401
1011: AVALGEN   -100.0
1020: NOTIN       B402
1030: NOTIN       B411
1040: NOTIN       B410
1050: NOTIN       B409
1060: NOTIN       B407
1065: NOTIN       B414
1066: NOTIN       B415
1070: AND2        B402, B8905
1080: AND2       B1020, B8900
1090: OR2        B1070, B1080
1095: AND2       B1010, B8910
1098: AND2        B401, B8915
1100: HDFAIL      B416
1110: HDFAIL      B431
1111: AVALGEN   -1.000
1112: AVALGEN   -1.000
1113: AVALGEN   -0.500
1114: AVALGEN   0.5000
1115: AVALGEN   0.0180
1116: AVALGEN   -0.018
1117: AVALGEN   0.0440
1118: AVALGEN   0.1500
1120: HISIGMTV   B1005,  B100,2.0000
1125: AVALGEN   125.00
1130: LOSIGMTV   B1005, B1001,2.0000
1140: HDFAIL      B103
1150: OR8        B1120, B1130, B1140, B1130, B1130, B1130, B1130, B1130
1159: AVALGEN   18.750
1160: LOSIGMTV   B1005, B1159,0.0000
1170: HISIGMTV   B1004,  B100,2.0000
1180: LOSIGMTV   B1004, B1009,2.0000
1190: HDFAIL      B101
1200: OR8        B1170, B1180, B1190, B1180, B1180, B1180, B1180, B1180
1205: NOTIN      B1200
1210: HISIGMTV   B1003,  B100,2.0000
1220: LOSIGMTV   B1003, B1001,2.0000
1230: HDFAIL      B102
1240: OR8        B1210, B1220, B1230, B1220, B1220, B1220, B1220, B1220
1250: LOSIGMTV   B1003,   B10,2.0000
1260: NOTIN      B1240
1270: AND2       B1260, B1250
1290: HISIGMTV   B1006,  B100,2.0000
1300: LOSIGMTV   B1006, B1001,2.0000
1310: HDFAIL      B104
1320: OR8        B1290, B1300, B1310, B1300, B1300, B1300, B1300, B1300
1330: TRANSF     B2637, B1006, B1320
```

```
1340: HISIGMTV  B1007,  B100,2.0000
1350: LOSIGMTV  B1007, B1001,2.0000
1360: HDFAIL     B105
1370: OR8       B1340, B1350, B1360, B1350, B1350, B1350, B1350, B1350
1380: HISIGMTV  B1007,   B98,2.0000
1390: NOTIN     B1370
1400: AND2      B1390, B1380
1410: HISIGMTV   B121,  B100,2.0000
1420: LOSIGMTV   B121, B1001,2.0000
1430: HDFAIL     B121
1440: OR8       B1410, B1420, B1430, B1420, B1420, B1420, B1420, B1420
1441: DBEQUALS   B121, B1445,1.0000
1443: NOTIN     B1441
1445: TRACK      B121, B8916, B1443,0.1000
1450: HISIGMTV   B122,  B100,2.0000
1460: LOSIGMTV   B122, B1001,2.0000
1470: HDFAIL     B122
1480: OR8       B1450, B1460, B1470, B1460, B1460, B1460, B1460, B1460
1481: DBEQUALS   B122, B1485,1.0000
1483: NOTIN     B1481
1485: TRACK      B122, B8917, B1483,0.1000
1490: HISIGMTV   B123,  B100,2.0000
1500: LOSIGMTV   B123, B1001,2.0000
1510: HDFAIL     B123
1520: OR8       B1490, B1500, B1510, B1500, B1500, B1500, B1500, B1500
1521: DBEQUALS   B123, B1524,1.0000
1523: NOTIN     B1521
1524: TRACK      B123, B8918, B1523,0.1000
1525: OR8       B1150, B1200, B1240, B1320, B1370, B1440, B1480, B1520
1530: HISIGMTV   B111,  B100,2.0000
1540: LOSIGMTV   B111, B1001,2.0000
1550: HDFAIL     B111
1560: OR8       B1530, B1540, B1550, B1540, B1540, B1540, B1540, B1540
1570: HISIGMTV. B1008,  B100,2.0000
1580: LOSIGMTV  B1008, B1001,2.0000
1590: HDFAIL     B110
1600: OR8       B1570, B1580, B1590, B1580, B1580, B1580, B1580, B1580
1610: HISIGMTV   B114,  B100,2.0000
1620: LOSIGMTV   B114, B1001,2.0000
1630: HDFAIL     B114
1640: OR8       B1610, B1620, B1630, B1620, B1620, B1620, B1620, B1620
1650: HISIGMTV   B115,  B100,2.0000
1660: LOSIGMTV   B115, B1001,2.0000
1670: HDFAIL     B115
1680: OR8       B1650, B1660, B1670, B1660, B1660, B1660, B1660, B1660
1690: HISIGMTV   B113,  B100,2.0000
1700: LOSIGMTV   B113, B1001,2.0000
1710: HDFAIL     B113
1720: OR8       B1690, B1700, B1710, B1700, B1700, B1700, B1700, B1700
1730: DBEQUALS   B109,  B108,2.0000
1740: DBEQUALS   B108,  B107,2.0000
1750: DBEQUALS   B109,  B107,2.0000
1760: AND8      B1730, B1740, B1750, B1750, B1750, B1750, B1750, B1750
1770: HDFAIL     B107
1780: HISIGMTV   B107, B1125,2.0000
1800: OR8       B1780, B1770, B1770, B1770, B1770, B1770, B1770, B1770
1810: HDFAIL     B108
1820: HISIGMTV   B108, B1125,2.0000
1840: OR8       B1820, B1810, B1810, B1810, B1810, B1810, B1810, B1810
1850: HDFAIL     B109
1860: HISIGMTV   B109, B1125,2.0000
1880: OR8       B1860, B1850, B1850, B1850, B1850, B1850, B1850, B1850
1890: AND2      B1730, B1800
```

```
1900: AND2       B1800, B1880
1910: AND2       B1840, B1750
1920: AND2       B1800, B1840
1930: AND2       B1740, B1880
1940: AND2       B1880, B1840
1950: OR8        B1760, B1890, B1900, B1910, B1920, B1930, B1940, B1940
1960: TRANSF     B1001,  B109, B1880
1970: TRANSF     B1001,  B108, B1840
1980: TRANSF     B1001,  B107, B1800
1990: MEDSEL     B1960, B1970, B1980
2000: TRANSF     B1001, B1990, B1950
2010: OR8        B1800, B1840, B1880, B1880, B1880, B1880, B1880, B1880
2012: DBEQUALS   B1008, B4391,2.0000
2014: DBEQUALS    B111, B3349,2.0000
2016: OR2        B2012, B2014
2020: DBEQUALS    B114, B3340,10.000
2030: DBEQUALS    B115, B3340,10.000
2035: GAINBI     B4391,-1.000,100.00
2040: DBEQUALS    B113, B2035,10.000
2050: OR8        B2020, B2030, B2040, B2040, B2040, B2040, B2040, B2040
2060: LOSIGMTV    B114,    B2,1.0000
2070: HISIGMTV    B114,   B99,2.0000
2080: LOSIGMTV    B115,    B2,1.0000
2090: HISIGMTV    B115,   B99,2.0000
2100: LOSIGMTV    B113,    B2,1.0000
2110: HISIGMTV    B113,   B99,2.0000
2120: OR2         B407, B1020
2130: OR2        B2580, B2590
2135: NOTIN      B2130
2140: OR2        B2550, B2560
2145: NOTIN      B2140
2150: OR2        B2560, B2590
2160: OR8        B1160, B5510, B2570:  :570, B2570, B2570, B2570, B2570
2170: AND8        B800,  B402, B2260, B2260, B2260, B2260, B2260, B2260
2180: AND2        B800, B2265
2185: OR2        B2180, B1080
2190: OR8        B1950, B2170, B1070, B1070, B1070, B1070, B1070, B1070
2200: AND2        B801, B2270
2205: HISIGMTV   B1330, B2637,0.0000
2210: AND8        B801, B2275, B2205, B2205, B2205, B2205, B2205, B2205
2220: OR8        B1320, B2120, B2200, B2200, B2200, B2200, B2200, B2200
2230: AND2        B419, B2280
2240: AND8        B802, B2285, B2249, B2249, B2249, B2249, B2249, B2249
2248: DBEQUALS    B121, B3120,2.0000
2249: NOTIN      B2248
2250: OR8        B2120, B2230, B1440, B1050, B1050, B1050, B1050, B1050
2260: SRFLOP     B2185, B2190
2265: NOTIN      B2260
2270: SRFLOP     B2210, B2220
2275: NOTIN      B2270
2280: SRFLOP     B2240, B2250
2285: NOTIN      B2280
2290: AND8        B809, B2565, B2550, B2550, B2550, B2550, B2550, B2550
2300: AND8       B2550,  B810, B2585, B2585, B2585, B2585, B2585, B2585
2302: AND2        B808, B2555
2310: AND8        B811, B2550, B2595, B2550, B2550, B2550, B2550, B2550
2320: AND2        B809, B2560
2330: OR8        B1200, B2120, B1520, B1030, B2320, B2302, B2160, B2160
2340: AND2        B810, B2580
2350: OR8        B2120, B1240, B2340, B2302, B2160, B2160, B2160, B2160
2360: AND2        B811, B2590
2370: OR8        B1240, B2120, B1480, B1040, B2360, B2302, B2160, B2160
2380: AND2        B807, B2545
2390: AND2       B2540,  B807
```

```
2400: OR8        B1150, B2120, B2390, B2390, B2390, B2390, B2390, B2390
2410: AND8        B806, B2575, B1010, B1010, B1010, B1010, B1010, B1010
2420: AND2        B806, B2570
2430: OR8        B2420, B1095, B1065, B1065, B1065, B1065, B1065, B1065
2450: AND2       B2350, B2580
2460: AND2       B2370, B2590
2470: AND2       B2330, B2560
2473: NOTIN      B2110
2475: AND8        B402, B8903, B2473, B1060, B1060, B1060, B1060, B1060
2480: OR8        B2302, B2450, B2460, B2475, B2470, B2470, B2470, B2470
2490: AND2        B808, B2550
2495: NOTIN      B2370
2500: AND2       B2310, B2495
2505: NOTIN      B2350
2510: AND2       B2300, B2505
2515: NOTIN      B2330
2520: AND2       B2290, B2515
2530: OR8        B2160, B2120, B1200, B2490, B2500, B2510, B2520, B2520
2532: NOTIN      B2530
2533: AND8       B3840, B2480, B2532, B2532, B2532, B2532, B2532, B2532
2534: NOTIN      B3840
2537: AND2       B2534, B2480
2538: OR2        B2533, B2537
2540: SRFLOP     B2380, B2400
2541: NOTIN      B2350
2542: AND2       B2300, B2541
2545: NOTIN      B2540
2550: SRFLOP     B2480, B2530
2555: NOTIN      B2550
2560: SRFLOP     B2290, B2330
2565: NOTIN      B2560
2570: SRFLOP     B2410, B2430
2575: NOTIN      B2570
2580: SRFLOP     B2300, B2350
2585: NOTIN      B2580
2590: SRFLOP     B2310, B2370
2595: NOTIN      B2590
2600: AND2        B805, B2630
2610: AND8       B2635, B3017,  B805,  B805,  B805,  B805,  B805,  B805
2620: OR8        B2600, B1010, B2905, B1090, B1090, B1090, B1090, B1090
2630: SRFLOP     B2610, B2620
2635: NOTIN      B2630
2637: AVALGEN   71.250
2638: AVALGEN   0.2910
2639: AVALGEN   0.0625
2640: LOSIGMTV   B1330, B2637,2.0000
2645: AND8       B2640,  B402, B2270, B2270, B2270, B2270, B2270, B2270
2650: TRANSF     B1118, B1117, B2630
2660: TRANSF     B2638, B2639, B2630
2680: TRANSF     B2660, B2650,  B402
2690: GAINBI     B2680,-1.000,0.0000
2700: HISIGMTV   B3120, B3140,0.0000
2710: TRANSF     B2690, B2680, B2700
2720: TRANSF     B1112, B2710, B2645
2770: NOTIN       B420
2780: NOTIN       B421
2790: AND8        B421, B2770, B1060, B1060, B1060, B1060, B1060, B1060
2800: AND8        B420, B2780, B1060, B1060, B1060, B1060, B1060, B1060
2810: OR2        B2800, B2790
2820: AND2       B1020, B2810
2829: TRANSF     B1115, B1114, B1020
2830: TRANSF     B2829, B1001, B2790
2839: TRANSF     B1116, B1113, B1020
2840: TRANSF     B2839, B1001, B2800
```

```
2850: TRANSF     B2860, B1001, B2810
2860: SUM4W      B2850, B2830, B2840, B2840,1.0000,1.0000,1.0000,1.0000
2870: SUM2       B2860, B3140
2880: HILMT      B2870,100.00
2890: LOLMT      B2880,0.0000
2900: DBEQUALS   B3120, B3140,0.0000
2905: NOTIN      B2900
2910: DBDLTA     B3140, B3120,0.0000
2920: MULTDIV    B2720,   B30,   B60
2930: ABSVAL     B2910
2940: ABSVAL     B2920
2950: LOSEL4     B2930, B2940, B2940, B2940
2960: GAINBI     B2950,-1.000,0.0000
2980: TRANSF     B2960, B2950, B2700
2990: SUM2       B2980, B3120
2995: SUM2       B3120, B2920
2997: LOLMT      B2995,10.000
3000: AND8       B2645, B1060,  B402,  B402,  B402,  B402,  B402,  B402
3002: OR8        B2645,  B423, B2280,  B407, B2905, B2810, B2810, B2810
3007: SRFLOP      B803, B3002
3012: OR8        B2645,  B804, B2900, B2810, B2810, B2810, B2810, B2810
3013: OR8        B3007,  B407, B2905, B2905, B2905, B2905, B2905, B2905
3017: SRFLOP     B3012, B3013
3020: AND8       B3007, B1060, B2900, B2900, B2900, B2900, B2900, B2900
3025: AVG4W       B114,  B114,  B115,  B115,1.0000,1.0000,1.0000,1.0000
3030: TRANSF     B1445, B3120, B2280
3033: AND2       B2540, B8902
3035: TRANSF     B1005, B3030, B3033
3040: TRANSF     B2990, B3035, B3020
3050: SUM2       B3025,    B5
3060: TRANSF     B3050, B3040, B1070
3065: TRANSF     B2997, B3060, B3000
3067: AND2       B8919, B1066
3069: OR2        B1080, B3067
3070: TRANSF       B80, B3065, B3069
3080: AND2       B1010, B1010
3085: OR2        B3080,  B415
3090: TRANSF     B1001, B3070, B3085
3093: GAINBI     B3243,-1.000,0.0000
3095: SUM4W       B111, B3093, B1001, B1001,1.0000,0.1000,0.0000,0.0000
3100: TRANSF     B3095, B2000,  B402
3110: AND2        B407,  B401
3111: AND2       B8901, B2545
3112: OR8        B3110, B1098, B3111, B3111, B3111, B3111, B3111, B3111
3116: TRANSF     B3100, B3090, B3112
3118: LOLMT      B3116,0.0000
3120: HILMT      B3118,100.00
3129: OR2         B415, B3067
3130: OR8         B407, B1090, B3129, B1010, B1098, B2280, B3033, B3111
3140: TRANSF     B3120, B2890, B3130
3150: DBDLTA     B2000,   B80,0.0000
3160: DBEQUALS   B2000,   B80,0.2000
3170: TRANSF     B3150, B1001, B3160
3180: MULTDIV    B3170, B5556,    B1
3190: SUM2       B3180, B3120
3210: TRANSF     B3190, B3120, B2260
3211: HISIGMTV   B3120, B1005,0.0000
3212: AND2       B2080, B3211
3213: OR2        B2545, B3246
3214: OR2        B3213, B3212
3215: TRANSF     B1005, B3210, B3214
3220: DBDLTA     B3215, B1005,2.0000
3230: MULTDIV    B3220,    B1,    B1
3243: GAINBI     B4391,1.0000,0.0000
```

```
3244: MULTDIV    B111,    B1,    B1
3245: TRANSF    B3244, B3270,  B407
3246: OR2       B2130, B2140
3247: AND2      B3246, B2540
3248: TRANSF    B3250, B1001, B3247
3249: SUM4W     B3210, B3248, B3243, B1001,1.0000,0.1000,0.1000,0.0000
3250: PIDVLIM   B3230, B1001, B3345, B3213,0.5000,25.000,0.0000,0.0000
3260: AND8      B2540, B2555, B2565, B2585, B2595, B2595, B2595, B2595
3270: TRANSF    B3250, B3249, B3260
3280: MULTDIV   B3270,    B1,    B1
3284: OR8        B402,  B415, B2060, B2080, B2080, B2080, B2080, B2080
3285: TRANSF    B2000, B3120, B3284
3290: DBDLTA    B3285, B2000,0.0000
3292: GAINBI    B3335,-1.000,0.0000
3294: GAINBI    B1005,-1.000,0.0000
3296: SUM2      B3292, B3345
3298: SUM2      B3294, B3120
3300: AND2       B407, B1020
3302: MULTDIV   B3296,    B1,    B1
3304: MULTDIV   B3298,    B1,    B1
3306: TRANSF    B3302, B3304, B2540
3308: OR2       B2545, B3260
3310: MULTDIV    B111,    B1,    B1
3312: NOTIN     B3308
3316: OR2       B3212, B3308
3318: TRANSF    B1005, B3210, B3316
3320: PIDVLIM   B3290, B1001, B3310, B3300,5.0000,10.000,0.0000,0.0000
3322: DBDLTA    B3318, B1005,2.0000
3324: PIDVLIM   B3322, B1001, B3306, B3308,0.5000,25.000,0.0000,0.0000
3325: GAINBI    B3324,10.000,0.0000
3330: MULTDIV   B3320,    B1,    B1
3332: TRANSF    B3325, B1001, B3312
3333: HILMT     B3330,100.00
3334: HILMT     B3330,40.000
3335: SUM4W     B3243, B1001, B3120, B3332,0.1000,0.0000,1.0000,0.1000
3336: TRANSF    B3333, B3334,  B407
3337: TRANSF    B3250, B3335, B3260
3340: TRANSF    B3337, B3336,  B402
3345: TRANSF     B111, B3340,  B407
3346: AND2       B401, B2570
3347: TRANSF       B5, B3345, B3346
3348: OR2       B1080,  B415
3349: TRANSF    B1001, B3347, B3348
3370: DBEQUALS  B3349,  B111,2.0000
3380: NOTIN     B3370
3390: DBEQUALS  B4391, B1008,2.0000
3400: NOTIN     B3390
3405: OR2       B2260,  B402
3410: AND8      B3380, B3400, B3405,  B407,  B407,  B407,  B407,  B407
3420: NOTIN     B3430
3430: AND2      B3410, B3420
3435: AND2      B2285, B1060
3440: OR2       B3430, B3435
3450: AND2      B3410,  B419
3460: LOSIGMTV   B114, B1001,0.0000
3470: HISIGMTV   B114,  B100,0.0000
3480: LOSIGMTV   B115, B1001,0.0000
3490: HISIGMTV   B115,  B100,0.0000
3500: LOSIGMTV   B113, B1001,0.0000
3510: HISIGMTV   B113,  B100,0.0000
3580: AND2       B438, B1060
3590: AND2      B1060,  B437
3600: NOTIN     B3590
3610: NOTIN     B3580
```

```
3620: AND8      B3246, B3600, B3580,  B402,  B402,  B402,  B402,  B402
3630: AND8      B3246, B3610, B3590,  B402,  B402,  B402,  B402,  B402
3640: TRANSF       B1, B1001, B3620
3650: TRANSF    B1111, B3640, B3630
3660: SUM2      B3650, B3692
3670: HILMT     B3660,80.000
3680: LOLMT     B3670,0.0000
3690: OR2       B1010,  B407
3691: OR8       B2570, B3840, B1070, B1070, B1070, B1070, B1070, B1070
3692: TRANSF      B80, B3680, B3691
3699: TRANSF     B100, B3680, B3690
3700: GAINBI    B3699,-1.000,100.00
3710: AND8       B812, B1060,  B402,  B402,  B402,  B402,  B402,  B402
3720: OR8       B3710,  B813, B4386, B3840,  B407,  B407,  B407,  B407
3740: OR2       B2580, B2550
3750: AND8       B432,  B402, B1060, B1060, B1060, B1060, B1060, B1060
3760: AND8      B1060,  B402,  B431,  B431,  B431,  B431,  B431,  B431
3770: NOTIN     B3760
3780: NOTIN     B3750
3790: AND8      B3770, B3740, B3750, B3750, B3750, B3750, B3750, B3750
3800: AND8      B3740, B3760, B3780, B3780, B3780, B3780, B3780, B3780
3810: OR8        B813, B3800, B3790,  B407, B3840, B4386, B4386, B4386
3820: TRANSF    B1113, B1001, B3790
3830: TRANSF    B1114, B3820, B3800
3840: AND8      B2585, B2595, B2555, B1205, B2565, B2565, B2565, B2565
3850: TRANSF    B1111, B3830, B3840
3860: NOTIN     B2350
3890: AND2      B2300, B3860
3900: NOTIN     B2530
3910: AND2      B3900, B2480
3920: TRANSF    B1003, B1004, B3890
3940: TRANSF    B1524, B3920, B2560
3950: TRANSF    B1485, B3940, B2590
3960: OR8       B2590, B2560, B3890, B3910, B3890, B3890, B3890, B3890
3974: OR2       B3790, B3800
3975: TRANSF    B3980, B1001, B3974
3980: SUM2      B3850, B3975
3981: SUM2      B3980, B4000
3990: HILMT     B3981,100.00
3991: LOLMT     B3990,0.0000
3995: OR2       B3960, B3840
4000: TRANSF    B3950, B3991, B3995
4010: SRFLOP    B3710, B3810
4020: NOTIN     B4010
4030: AND2      B4020, B4385
4035: OR8        B440, B3800, B3790, B4030, B4030, B4030, B4030, B4030
4045: SRFLOP    B4035, B3720
4050: DBDLTA    B4000, B4219,0.0000
4060: ABSVAL    B4050
4070: MULTDIV      B1,   B30,   B60
4080: ABSVAL    B4070
4090: LOSEL4    B4060, B4080, B4080, B4080
4100: GAINBI    B4090,-1.000,0.0000
4105: HISIGMTV  B4126, B4000,0.0000
4106: AND2      B4105, B4105
4110: TRANSF    B4100, B4090, B4106
4115: TRANSF    B4110, B1001, B4010
4116: AVALGEN  0.0000
4117: NOTIN     B4105
4118: TRANSF    B4116, B4115, B3000
4119: AND2      B4117, B4376
4120: SUM2      B4118, B4126
4121: AND2      B2110, B4105
4122: OR2       B4119, B4121
```

```
4123: TRACK      B4120, B1004, B4122,1.0000
4126: TRANSF     B4000, B4123, B2538
4130: DBDLTA     B4000, B4279,0.0000
4140: ABSVAL     B4130
4150: MULTDIV      B1,   B30,   B60
4160: ABSVAL     B4150
4170: LOSEL4     B4140, B4160, B4160, B4160
4180: GAINBI     B4170,-1.000,0.0000
4185: HISIGMTV   B4204, B4000,0.0000
4186: AND2       B4185, B4185
4190: TRANSF     B4180, B4170, B4186
4195: TRANSF     B4190, B1001, B4010
4196: AVALGEN   -1.000
4197: NOTIN      B4185
4198: TRANSF     B4196, B4195, B3000
4199: AND2       B4197, B4376
4200: SUM2       B4198, B4204
4201: AND2       B2110, B4185
4202: OR2        B4199, B4201
4203: TRACK      B4200, B1003, B4202,1.0000
4204: TRANSF     B4000, B4203, B2542
4210: AND2       B2550, B2560
4219: TRANSF     B1004, B4126, B2145
4220: DBDLTA     B4219, B1004,0.0000
4230: MULTDIV    B4220,    B1,    B1
4240: PIDVLIM    B4230, B1001, B4250, B2145,0.5000,10.000,0.0000,0.0000
4250: TRANSF     B4240, B4391, B2140
4260: MULTDIV    B4250,    B1,    B1
4270: AND2       B2580, B2590
4279: TRANSF     B1003, B4204, B2135
4280: DBDLTA     B4279, B1003,0.0000
4290: MULTDIV    B4280,    B1,    B1
4300: PIDVLIM    B4290, B1001, B4310, B2135,0.2500,11.000,0.0000,0.0000
4310: TRANSF     B4300, B4391, B2130
4320: MULTDIV    B4310,    B1,    B1
4330: TRANSF     B4320, B4260, B2130
4340: SUM2       B1111, B4371
4350: LOLMT      B4340,0.0000
4351: GAINBI     B1008,1.0000,0.0000
4360: TRANSF     B4350, B4330, B3840
4365: TRANSF     B4351, B4360,  B407
4370: MULTDIV    B3270,    B1,    B1
4371: TRANSF     B4370, B4365, B2570
4373: DBEQUALS   B4382, B3699,0.0000
4374: NOTIN      B4373
4375: OR2        B4373, B3840
4376: NOTIN      B4375
4377: GAINBI     B4371,1.0000,0.0000
4381: GAINBI     B4371,1.0000,0.0000
4382: LOSEL4     B4381, B4381, B3699, B3699
4383: TRANSF     B4377, B4382, B2570
4384: TRANSF     B4279, B4219, B2130
4385: DBEQUALS   B4000, B4384,0.0000
4386: NOTIN      B4385
4388: TRANSF      B100, B4383, B1010
4390: GAINBI     B4000,1.0000,0.0000
4391: GAINBI     B4388,1.0000,0.0000
4395: GAINBI     B2000,0.8000,20.000
4400: GAINBI     B3699,-1.000,100.00
4410: GAINBI     B4000,0.4500,1.4700
4412: GAINBI     B4000,0.1750,0.4500
4415: TRANSF     B4410, B4412, B2130
4420: GAINBI     B2000,0.4500,-0.070
4430: GAINBI     B4391,-1.000,100.00
```

```
4440: GAINBI     B3349,1.0000,0.0000
4447: AND2       B4956, B4448
4448: AND2       B4956, B4449
4449: AND2       B4956, B4450
4450: AND2       B4956, B4460
4460: AND2       B4956, B4470
4470: AND2       B4956, B4480
4480: AND2       B4956, B4490
4490: AND2       B4956, B4500
4500: AND2       B4956, B4510
4510: AND2       B4956, B4520
4520: AND2       B4956, B4530
4530: AND2       B4956, B4540
4540: AND2       B4956, B4550
4550: AND2       B4956, B4560
4560: AND2       B4956, B4570
4570: AND2       B4956, B4580
4580: AND2       B4956, B4590
4590: AND2       B4956, B4600
4600: AND2       B4956, B4610
4610: AND2       B4956, B4620
4620: AND2       B4956, B4630
4630: AND2       B4956, B4640
4640: AND2       B4956, B4650
4650: AND2       B4956, B4660
4660: AND2       B4956, B4670
4670: AND2       B4956, B4680
4680: AND2       B4956, B4690
4690: AND2       B4956, B4700
4700: AND2       B4956, B4710
4710: AND2       B4956, B4720
4720: AND2       B4956, B4730
4730: AND2       B4956, B4740
4740: AND2       B4956, B4750
4750: AND2       B4956, B4760
4760: AND2       B4956, B4770
4770: AND2       B4956, B4780
4780: AND2       B4956, B4790
4790: AND2       B4956, B4800
4800: AND2       B4956, B4810
4810: AND2       B4956, B4820
4820: AND2       B4956, B4830
4830: AND2       B4956, B4840
4840: AND2       B4956, B4850
4850: AND2       B4956, B4860
4860: AND2       B4956, B4870
4870: AND2       B4956, B4880
4880: AND2       B4956, B4890
4890: AND2       B4956, B4900
4900: AND2       B4956, B4910
4910: AND2       B4956, B4920
4920: AND2       B4956, B4930
4930: AND2       B4956, B4940
4940: AND2       B4956, B4950
4950: AND2       B4956, B4970
4951: NOTIN      B4447
4952: NOTIN       B444
4953: AND2       B4951, B4956
4954: NOTIN      B4953
4955: AND2       B4952, B4954
4956: NOTIN      B4955
4960: TIMEDEL    B4956,0.1000
4970: XOR2       B4956, B4960
4980: OR2        B4910, B1200
```

```
4990:  OR2       B4940, B2010
5000:  OR2       B4930, B1400
5010:  OR2       B4920, B1320
5020:  OR2       B4880, B2016
5030:  OR2       B4890, B2050
5040:  OR2       B4870,  B403
5050:  OR2       B4860,  B404
5060:  OR2       B4800, B2060
5070:  OR2       B4790, B2070
5080:  OR2       B4780, B2080
5090:  OR2       B4770, B2090
5100:  OR2       B4760, B2100
5110:  OR2       B4750, B2110
5120:  OR2       B4610,  B413
5130:  OR2       B4600,  B412
5140:  OR8       B8465, B4740,  B401,  B401,  B401,  B401,  B401,  B401
5150:  OR2       B4730, B2265
5160:  OR2       B4720, B2260
5170:  OR2       B4710, B2275
5180:  OR2       B4700, B2270
5190:  OR2       B4690, B2280
5200:  OR2       B4680, B3440
5210:  OR2       B4660, B2800
5220:  OR2       B4670, B2790
5230:  OR2       B4650, B3007
5240:  OR2       B4640, B3017
5250:  OR2       B4630, B2630
5260:  OR2       B4620, B2635
5270:  OR2       B4590,  B408
5280:  OR2       B4580, B3800
5290:  OR2       B4570, B3790
5291:  OR2       B2570, B4460
5292:  OR2       B2540, B4449
5293:  OR2       B2545, B4450
5300:  OR2       B4560, B2555
5310:  OR2       B4550, B2550
5320:  OR2       B4540, B2565
5330:  OR2       B4530, B2560
5340:  OR2       B4520, B2585
5350:  OR2       B4510, B2580
5360:  OR2       B4500, B2595
5370:  OR2       B4490, B2590
5380:  OR2       B4480, B3630
5390:  OR2       B4470, B3620
5400:  OR2       B4448, B4010
5410:  OR2       B4447, B4045
5420:  OR2       B4900, B1270
5430:  OR2       B4940, B4940
5440:  OR2       B4870, B4870
5450:  OR2       B4850, B4850
5460:  OR2       B4840, B4840
5470:  OR2       B4830, B4830
5480:  OR2       B4820, B4820
5490:  XOR2      B4810, B5510
5498:  GAINBI    B3140,0.9600,0.0000
5499:  GAINBI    B3140,0.7000,0.0000
5500:  GAINBI    B3140,45.000,0.0000
5501:  TRANSF    B5498, B5499, B2540
5502:  TRANSF    B5501, B5500,  B402
5503:  LOLMT     B5502,0.0000
5510:  DVALGEN       0
5520:  DVALGEN       1
5528:  GAINBI    B3120,0.9600,0.0000
5529:  GAINBI    B3120,0.7000,0.0000
```

```
5530: GAINBI     B3120,45.000,0.0000
5531: TRANSF     B5528, B5529, B2540
5532: TRANSF     B5531, B5530,  B402
5533: LOLMT      B5532,0.0000
5555: AVALGEN   0.5000
5556: AVALGEN   -25.00
8461: NOTIN       B401
8463: NOTIN      B8463
8465: AND2       B8461, B8463
8900: OR2         B402,  B402
8901: OR2        B2540, B2540
8902: NOTIN      B8901
8903: OR2         B407,  B407
8904: NOTIN      B8904
8905: NOTIN      B8900
8910: OR2         B401,  B401
8915: NOTIN      B8910
8916: MULTDIV     B121,    B1,    B1
8917: MULTDIV     B122,    B1,    B1
8918: MULTDIV     B123,    B1,    B1
8919: OR2         B415,  B415
8920: OR2         B416,  B416
8921: OR2         B417,  B417
8922: OR2         B418,  B418
8923: OR2         B422,  B422
8924: OR2         B423,  B423
8925: OR2         B424,  B424
8926: OR2         B427,  B427
8927: OR2         B443,  B443
8928: OR2         B433,  B433
8929: OR2         B434,  B434
8930: OR2         B435,  B435
8931: OR2         B436,  B436
8932: OR2         B439,  B439
8933: OR2         B440,  B440
8940: NOTIN      B8920
8941: NOTIN      B8921
8942: NOTIN      B8922
8943: NOTIN      B8923
8944: NOTIN      B8924
8945: NOTIN      B8925
8946: NOTIN      B8926
8947: NOTIN      B8927
8948: NOTIN      B8928
8949: NOTIN      B8929
8950: NOTIN      B8930
8951: NOTIN      B8931
8952: NOTIN      B8932
8953: NOTIN      B8933
8960: AND2       B1020, B2265
9002: AVALGEN   3.0000
9301: ANOUT      B4390,  A301,   22
9302: ANOUT      B4395,  A302,    1
9305: ANOUT      B4400,  A305,   .2
9306: ANOUT      B4415,  A306,   22
9307: ANOUT      B4420,  A307,   24
9313: ANOUT      B4430,  A313,   22
9314: ANOUT      B4440,  A314,   22
9401: DGOUT      B5420,  D301
9402: DGOUT      B4980,  D302
9403: DGOUT      B5430,  D303
9404: DGOUT      B4990,  D304
9405: DGOUT      B5000,  D305
9406: DGOUT      B5010,  D306
```

```
9407: DGOUT      B5020,  D307
9408: DGOUT      B5030,  D308
9409: DGOUT      B5040,  D309
9410: DGOUT      B5050,  D310
9411: DGOUT      B5450,  D311
9412: DGOUT      B5460,  D312
9413: DGOUT      B5470,  D313
9414: DGOUT      B5480,  D314
9415: DGOUT      B5490,  D315
9417: DGOUT      B5060,  D317
9418: DGOUT      B5070,  D318
9419: DGOUT      B5080,  D319
9420: DGOUT      B5090,  D320
9421: DGOUT      B5100,  D321
9422: DGOUT      B5110,  D322
9423: DGOUT      B5120,  D323
9424: DGOUT      B5130,  D324
9425: DGOUT      B8960,  D325
9426: DGOUT      B3450,  D326
9448: IBCDOUT    B5533,  D333
9449: DGOUT      B5520,  D356
9450: DGOUT      B5510,  D356
9451: MULTDIV      B1,     B1,     B1
9452: MULTDIV      B1,     B1,     B1
9453: MULTDIV      B1,     B1,     B1
9461: IBCDOUT    B5503,  D333
9462: DGOUT      B5520,  D350
9463: DGOUT      B5510,  D350
9465: DGOUT      B5140,  D365
9466: DGOUT      B5150,  D366
9467: DGOUT      B5160,  D367
9468: DGOUT      B5170,  D368
9469: DGOUT      B5180,  D369
9470: DGOUT      B5190,  D370
9471: DGOUT      B5200,  D371
9472: DGOUT      B5210,  D372
9473: DGOUT      B5220,  D373
9474: DGOUT      B5230,  D374
9475: DGOUT      B5240,  D375
9476: DGOUT      B5250,  D376
9477: DGOUT      B5260,  D377
9478: DGOUT      B5270,  D378
9479: DGOUT      B5291,  D379
9481: DGOUT      B5280,  D381
9482: DGOUT      B5290,  D382
9483: DGOUT      B5300,  D383
9484: DGOUT      B5310,  D384
9485: DGOUT      B5320,  D385
9486: DGOUT      B5330,  D386
9487: DGOUT      B5340,  D387
9488: DGOUT      B5350,  D388
9489: DGOUT      B5360,  D389
9490: DGOUT      B5370,  D390
9491: DGOUT      B5380,  D391
9492: DGOUT      B5390,  D392
9493: DGOUT      B5400,  D393
9494: DGOUT      B5410,  D394
9495: DGOUT      B5293,  D395
9496: DGOUT      B5292,  D396
9497: DGOUT      B1010,  D397
9498: DGOUT      B2010,  D398
9499: DGOUT      B1400,  D399
9500: DGOUT      B1320,  D400
9501: DGOUT      B1200,  D401
```

```
9502: DGOUT      B1270,  D402
9503: DGOUT      B2050,  D403
9504: DGOUT       B403,  D404
9513: DGOUT       B404,  D413
9514: DGOUT      B2280,  D414
9515: DGOUT      B2565,  D415
9516: DGOUT      B2595,  D416
9517: DGOUT      B2275,  D417
9518: DGOUT       B426,  D418
9519: DGOUT      B4376,  D419
9520: DGOUT       B425,  D420
9535: DGOUT      B2016,  D435
9536: DGOUT      B5520,  D436
9998: DISPLAYA  B3322,5.0000,50.000
9999: DISPLAYB  B4220,5.0000,50.000
ENTER: LOAD,GO,TUNE,LIST,TAPE,MSG
```

APPENDIX C

MTCS-20$^{tm}$ ADDRESS LABEL CONVERSION TABLE

DIGITAL INPUT LABEL TO DIOB ADDRESS CONVERSION:

| LABEL | DIOB ADDRESS | BIT POSITION | LABEL | DIOB ADDRESS | BIT POSITION |
|---|---|---|---|---|---|
| D1 | xx1E6H | 0 | D40 | xx1DEH | 9 |
| D2 | xx1E6H | 1 | D41 | xx1DEH | 10 |
| D3 | xx1E6H | 2 | D42 | xx1DEH | 11 |
| D4 | xx1E6H | 3 | D43 | xx1DEH | 12 |
| D5 | xx1E6H | 4 | D44 | xx1DEH | 13 |
| D6 | xx1E6H | 5 | D45 | xx1DEH | 14 |
| D7 | xx1E6H | 6 | D46 | xx1DAH | 0 |
| D8 | xx1E6H | 7 | D47 | xx1DAH | 1 |
| D9 | xx1E6H | 8 | D48 | xx1DAH | 2 |
| D10 | xx1E6H | 9 | D49 | xx1DAH | 3 |
| D11 | xx1E6H | 10 | D50 | xx1DAH | 4 |
| D12 | xx1E6H | 11 | D51 | xx1DAH | 5 |
| D13 | xx1E6H | 12 | D52 | xx1DAH | 6 |
| D14 | xx1E6H | 13 | D53 | xx1DAH | 7 |
| D15 | xx1E2H | 14 | D54 | xx1DAH | 8 |
| D16 | xx1E2H | 0 | D55 | xx1DAH | 9 |
| D17 | xx1E2H | 1 | D56 | xx1DAH | 10 |
| D18 | xx1E2H | 2 | D57 | xx1DAH | 11 |
| D19 | xx1E2H | 3 | D58 | xx1DAH | 12 |
| D20 | xx1E2H | 4 | D59 | xx1DAH | 13 |
| D21 | xx1E2H | 5 | D60 | xx1DAH | 14 |
| D22 | xx1E2H | 6 | D61 | xx1D6H | 0 |
| D23 | xx1E2H | 7 | D62 | xx1D6H | 1 |
| D24 | xx1E2H | 8 | D63 | xx1D6H | 2 |
| D25 | xx1E2H | 9 | D64 | xx1D6H | 3 |
| D26 | xx1E2H | 10 | D65 | xx1D6H | 4 |
| D27 | xx1E2H | 11 | D66 | xx1D6H | 5 |
| D28 | xx1E2H | 12 | D67 | xx1D6H | 6 |
| D29 | xx1E2H | 13 | D68 | xx1D6H | 7 |
| D30 | xx1E2H | 14 | D69 | xx1D6H | 8 |
| D31 | xx1E2H | 0 | D70 | xx1D6H | 9 |
| D32 | xx1E2H | 1 | D71 | xx1D6H | 10 |
| D33 | xx1E2H | 2 | D72 | xx1D6H | 11 |
| D34 | xx1E2H | 3 | D73 | xx1D6H | 12 |
| D35 | xx1E2H | 4 | D74 | xx1D6H | 13 |

| | | |
|---|---|---|
| D36 | xx1E2H | 5 |
| D37 | xx1E2H | 6 |
| D38 | xx1DEH | 7 |
| D39 | xx1DEH | 8 |
| D79 | xx1D2H | 3 |
| D80 | xx1D2H | 4 |
| D81 | xx1D2H | 5 |
| D82 | xx1D2H | 6 |
| D83 | xx1D2H | 7 |
| D84 | xx1D2H | 8 |
| D85 | xx1D2H | 9 |
| D86 | xx1D2H | 10 |
| D87 | xx1D2H | 11 |
| D88 | xx1D2H | 12 |
| D89 | xx1D2H | 13 |
| D90 | xx1D2H | 14 |
| D91 | xx16AH | 0 |
| D92 | xx16AH | 1 |
| D93 | xx16AH | 2 |
| D94 | xx16AH | 3 |
| D95 | xx16AH | 4 |
| D96 | xx16AH | 5 |
| D97 | xx16AH | 6 |
| D98 | xx16AH | 7 |
| D99 | xx16AH | 8 |
| D100 | xx16AH | 9 |
| D101 | xx16AH | 10 |
| D102 | xx16AH | 11 |
| D103 | xx16AH | 12 |
| D104 | xx16AH | 13 |
| D105 | xx16AH | 14 |
| D106 | xx15AH | 0 |
| D107 | xx15AH | 1 |
| D108 | xx15AH | 2 |
| D109 | xx15AH | 3 |
| D110 | xx15AH | 4 |
| D111 | xx15AH | 5 |
| D112 | xx15AH | 6 |
| D113 | xx15AH | 7 |
| D114 | xx15AH | 8 |
| D115 | xx15AH | 9 |
| D116 | xx15AH | 10 |
| D117 | xx15AH | 11 |
| D118 | xx15AH | 12 |
| D119 | xx15AH | 13 |
| D120 | xx15AH | 14 |
| D121 | xx14AH | 0 |
| D122 | xx14AH | 1 |
| D167 | xx11AH | 1 |
| D168 | xx11AH | 2 |
| D169 | xx11AH | 3 |
| D170 | xx11AH | 4 |
| D171 | xx11AH | 5 |
| D172 | xx11AH | 6 |
| D173 | xx11AH | 7 |
| D174 | xx11AH | 8 |
| D175 | xx11AH | 9 |
| D176 | xx11AH | 10 |
| D177 | xx11AH | 11 |
| D178 | xx11AH | 12 |
| D179 | xx11AH | 13 |
| D180 | xx11AH | 14 |
| D181 | xx10AH | 0 |
| D182 | xx10AH | 1 |
| D183 | xx10AH | 2 |

| | | |
|---|---|---|
| D75 | xx1D6H | 14 |
| D76 | xx1D2H | 0 |
| D77 | xx1D2H | 1 |
| D78 | xx1D2H | 2 |
| D123 | xx14AH | 2 |
| D124 | xx14AH | 3 |
| D125 | xx14AH | 4 |
| D126 | xx14AH | 5 |
| D127 | xx14AH | 6 |
| D128 | xx14AH | 7 |
| D129 | xx14AH | 8 |
| D130 | xx14AH | 9 |
| D131 | xx14AH | 10 |
| D132 | xx14AH | 11 |
| D133 | xx14AH | 12 |
| D134 | xx14AH | 13 |
| D135 | xx14AH | 14 |
| D136 | xx13AH | 0 |
| D137 | xx13AH | 1 |
| D138 | xx13AH | 2 |
| D139 | xx13AH | 3 |
| D140 | xx13AH | 4 |
| D141 | xx13AH | 5 |
| D142 | xx13AH | 6 |
| D143 | xx13AH | 7 |
| D144 | xx13AH | 8 |
| D145 | xx13AH | 9 |
| D146 | xx13AH | 10 |
| D147 | xx13AH | 11 |
| D148 | xx13AH | 12 |
| D149 | xx13AH | 13 |
| D150 | xx13AH | 14 |
| D151 | xx12AH | 0 |
| D152 | xx12AH | 1 |
| D153 | xx12AH | 2 |
| D154 | xx12AH | 3 |
| D155 | xx12AH | 4 |
| D156 | xx12AH | 5 |
| D157 | xx12AH | 6 |
| D158 | xx12AH | 7 |
| D159 | xx12AH | 8 |
| D160 | xx12AH | 9 |
| D161 | xx12AH | 10 |
| D162 | xx12AH | 11 |
| D163 | xx12AH | 12 |
| D164 | xx12AH | 13 |
| D165 | xx12AH | 14 |
| D166 | xx11AH | 0 |
| D196 | xx106H | 0 |
| D197 | xx106H | 1 |
| D198 | xx106H | 2 |
| D199 | xx106H | 3 |
| D200 | xx106H | 4 |
| D201 | xx106H | 5 |
| D202 | xx106H | 6 |
| D203 | xx106H | 7 |
| D204 | xx106H | 8 |
| D205 | xx106H | 9 |
| D206 | xx106H | 10 |
| D207 | xx106H | 11 |
| D208 | xx106H | 12 |
| D209 | xx106H | 13 |
| D210 | xx106H | 14 |
| D211 | xx102H | 0 |
| D212 | xx102H | 1 |

DIGITAL INPUT LABEL TO DIOB ADDRESS CONVERSION: (Cont'd)

| LABEL | DIOB ADDRESS | BIT POSITION |
|---|---|---|
| D184 | xx10AH | 3 |
| D185 | xx10AH | 4 |
| D186 | xx10AH | 5 |
| D187 | xx10AH | 6 |
| D188 | xx10AH | 7 |
| D189 | xx10AH | 8 |
| D190 | xx10AH | 9 |
| D191 | xx10AH | 10 |
| D192 | xx10AH | 11 |
| D193 | xx10AH | 12 |
| D194 | xx10AH | 13 |
| D195 | xx10AH | 14 |
| D301 | xx1E8H | 0 |
| D302 | xx1E8H | 1 |
| D303 | xx1E8H | 2 |
| D304 | xx1E8H | 3 |
| D305 | xx1E8H | 4 |
| D306 | xx1E8H | 5 |
| D307 | xx1E8H | 6 |
| D308 | xx1E8H | 7 |
| D309 | xx1E8H | 8 |
| D310 | xx1E8H | 9 |
| D311 | xx1E8H | 10 |
| D312 | xx1E8H | 11 |
| D313 | xx1E8H | 12 |
| D314 | xx1E8H | 13 |
| D315 | xx1E8H | 14 |
| D316 | xx1E8H | 15 |
| D317 | xx1E4H | 0 |
| D318 | xx1E4H | 1 |
| D319 | xx1E4H | 2 |
| D320 | xx1E4H | 3 |
| D321 | xx1E4H | 4 |
| D322 | xx1E4H | 5 |
| D323 | xx1E4H | 6 |
| D324 | xx1E4H | 7 |
| D325 | xx1E4H | 8 |
| D326 | xx1E4H | 9 |
| D327 | xx1E4H | 10 |
| D328 | xx1E4H | 11 |
| D329 | xx1E4H | 12 |
| D330 | xx1E4H | 13 |
| D331 | xx1E4H | 14 |
| D332 | xx1E4H | 15 |
| D333 | xx1E0H | 0 |
| D334 | xx1E0H | 1 |
| D335 | xx1E0H | 2 |
| D336 | xx1E0H | 3 |
| D337 | xx1E0H | 4 |
| D338 | xx1E0H | 5 |
| D339 | xx1E0H | 6 |
| D340 | xx1E0H | 7 |
| D341 | xx1E0H | 8 |
| D342 | xx1E0H | 9 |
| D343 | xx1E0H | 10 |
| D344 | xx1E0H | 11 |
| D213 | xx102H | 2 |
| D214 | xx102H | 3 |
| D215 | xx102H | 4 |
| D216 | xx102H | 5 |
| D217 | xx102H | 6 |
| D218 | xx102H | 7 |
| D219 | xx102H | 8 |
| D220 | xx102H | 9 |
| D221 | xx102H | 10 |
| D222 | xx102H | 11 |
| D223 | xx102H | 12 |
| D224 | xxx12H | 13 |
| D225 | xx102H | 14 |
| D345 | xx1E0H | 12 |
| D346 | xx1E0H | 13 |
| D347 | xx1E0H | 14 |
| D348 | xx1E0H | 15 |
| D349 | xx1DCH | 0 |
| D350 | xx1DCH | 1 |
| D351 | xx1DCH | 2 |
| D352 | xx1DCH | 3 |
| D353 | xx1DCH | 4 |
| D354 | xx1DCH | 5 |
| D355 | xx1DCH | 6 |
| D356 | xx1DCH | 7 |
| D357 | xx1DCH | 8 |
| D358 | xx1DCH | 9 |
| D359 | xx1DCH | 10 |
| D360 | xx1DCH | 11 |
| D361 | xx1DCH | 12 |
| D362 | xx1DCH | 13 |
| D363 | xx1DCH | 14 |
| D364 | xx1DCH | 15 |
| D365 | xx1D8H | 0 |
| D366 | xx1D8H | 1 |
| D367 | xx1D8H | 2 |
| D368 | xx1D8H | 3 |
| D369 | xx1D8H | 4 |
| D370 | xx1D8H | 5 |
| D371 | xx1D8H | 6 |
| D372 | xx1D8H | 7 |
| D373 | xx1D8H | 8 |
| D374 | xx1D8H | 9 |
| D375 | xx1D8H | 10 |
| D376 | xx1D8H | 11 |
| D377 | xx1D8H | 12 |
| D378 | xx1D8H | 13 |
| D379 | xx1D8H | 14 |
| D380 | xx1D8H | 15 |
| D381 | xx1D4H | 0 |
| D382 | xx1D4H | 1 |
| D383 | xx1D4H | 2 |
| D384 | xx1D4H | 3 |
| D385 | xx1D4H | 4 |
| D386 | xx1D4H | 5 |
| D387 | xx1D4H | 6 |
| D388 | xx1D4H | 7 |

DIGITAL OUTPUT LABEL TO DIOB ADDRESS CONVERSION: (Cont'd)

| LABEL | DIOB ADDRESS | BIT POSITION | LABEL | DIOB ADDRESS | BIT POSITION |
|---|---|---|---|---|---|
| D389 | xx1D4H | 8 | D433 | xx158H | 4 |
| D390 | xx1D4H | 9 | D434 | xx158H | 5 |
| D391 | xx1D4H | 10 | D435 | xx158H | 6 |
| D392 | xx1D4H | 11 | D436 | xx158H | 7 |
| D393 | xx1D4H | 12 | D437 | xx158H | 8 |
| D394 | xx1D4H | 13 | D438 | xx158H | 9 |
| D395 | xx1D4H | 14 | D439 | xx158H | 10 |
| D396 | xx1D4H | 15 | D440 | xx158H | 11 |
| D397 | xx1D0H | 0 | D441 | xx158H | 12 |
| D398 | xx1D0H | 1 | D442 | xx158H | 13 |
| D399 | xx1D0H | 2 | D443 | xx158H | 14 |
| D400 | xx1D0H | 3 | D444 | xx158H | 15 |
| D401 | xx1D0H | 4 | D445 | xx148H | 0 |
| D402 | xx1D0H | 5 | D446 | xx148H | 1 |
| D403 | xx1D0H | 6 | D447 | xx148H | 2 |
| D404 | xx1D0H | 7 | D448 | xx148H | 3 |
| D405 | xx1D0H | 8 | D449 | xx148H | 4 |
| D406 | xx1D0H | 9 | D450 | xx148H | 5 |
| D407 | xx1D0H | 10 | D451 | xx148H | 6 |
| D408 | xx1D0H | 11 | D452 | xx148H | 7 |
| D409 | xx1D0H | 12 | D453 | xx148H | 8 |
| D410 | xx1D0H | 13 | D454 | xx148H | 9 |
| D411 | xx1D0H | 14 | D455 | xx148H | 10 |
| D412 | xx1D0H | 15 | D456 | xx148H | 11 |
| D413 | xx168H | 0 | D457 | xx148H | 12 |
| D414 | xx168H | 1 | D458 | xx148H | 13 |
| D415 | xx168H | 2 | D459 | xx148H | 14 |
| D416 | xx168H | 3 | D460 | xx148H | 15 |
| D417 | xx168H | 4 | D461 | xx138H | 0 |
| D418 | xx168H | 5 | D462 | xx138H | 1 |
| D419 | xx168H | 6 | D463 | xx138H | 2 |
| D420 | xx168H | 7 | D464 | xx138H | 3 |
| D421 | xx168H | 8 | D465 | xx138H | 4 |
| D422 | xx168H | 9 | D466 | xx138H | 5 |
| D423 | xx168H | 10 | D467 | xx138H | 6 |
| D424 | xx168H | 11 | D468 | xx138H | 7 |
| D425 | xx168H | 12 | D469 | xx138H | 8 |
| D426 | xx168H | 13 | D470 | xx138H | 9 |
| D427 | xx168H | 14 | D471 | xx138H | 10 |
| D428 | xx168H | 15 | D472 | xx138H | 11 |
| D429 | xx158H | 0 | D473 | xx138H | 12 |
| D430 | xx158H | 1 | D474 | xx138H | 13 |
| D431 | xx158H | 2 | D475 | xx138H | 14 |
| D432 | xx158H | 3 | D476 | xx138H | 15 |
| D477 | xx128H | 0 | D509 | xx108H | 0 |
| D478 | xx128H | 1 | D510 | xx108H | 1 |
| D479 | xx128H | 2 | D511 | xx108H | 2 |
| D480 | xx128H | 3 | D512 | xx108H | 3 |
| D481 | xx128H | 4 | D513 | xx108H | 4 |
| D482 | xx128H | 5 | D514 | xx108H | 5 |
| D483 | xx128H | 6 | D515 | xx108H | 6 |
| D484 | xx128H | 7 | D516 | xx108H | 7 |
| D485 | xx128H | 8 | D517 | xx108H | 8 |
| D486 | xx128H | 9 | D518 | xx108H | 9 |
| D487 | xx128H | 10 | D519 | xx108H | 10 |
| D488 | xx128H | 11 | D520 | xx108H | 11 |
| D489 | xx128H | 12 | D521 | xx108H | 12 |
| D490 | xx128H | 13 | D522 | xx108H | 13 |
| D491 | xx128H | 14 | D523 | xx108H | 14 |

DIGITAL OUTPUT LABEL TO DIOB ADDRESS CONVERSION: (Cont'd)

| LABEL | DIOB ADDRESS | BIT POSITION | LABEL | DIOB ADDRESS | BIT POSITION |
|---|---|---|---|---|---|
| D492 | xx128H | 15 | D524 | xx108H | 15 |
| D493 | xx118H | 0 | D525 | xx104H | 0 |
| D494 | xx118H | 1 | D526 | xx104H | 1 |
| D495 | xx118H | 2 | D527 | xx104H | 2 |
| D496 | xx118H | 3 | D528 | xx104H | 3 |
| D497 | xx118H | 4 | D529 | xx104H | 4 |
| D498 | xx118H | 5 | D530 | xx104H | 5 |
| D499 | xx118H | 6 | D531 | xx104H | 6 |
| D500 | xx118H | 7 | D532 | xx104H | 7 |
| D501 | xx118H | 8 | D533 | xx104H | 8 |
| D502 | xx118H | 9 | D534 | xx104H | 9 |
| D503 | xx118H | 10 | D535 | xx104H | 10 |
| D504 | xx118H | 11 | D536 | xx104H | 11 |
| D505 | xx118H | 12 | D537 | xx104H | 12 |
| D506 | xx118H | 13 | D538 | xx104H | 13 |
| D507 | xx118H | 14 | D539 | xx104H | 14 |
| D508 | xx118H | 15 | D540 | xx104H | 15 |

ANALOG INPUT LABEL TO DIOB ADDRESS CONVERSION:

| LABEL | DIOB ADDRESS | LABEL | DIOB ADDRESS |
|---|---|---|---|
| A1 | xx010 | A44 | xx082 |
| A2 | xx012 | A45 | xx084 |
| A3 | xx014 | A46 | xx086 |
| A4 | xx016 | A47 | xx088 |
| A5 | xx018 | A48 | xx08A |
| A6 | xx01A | A49 | xx090 |
| A7 | xx020 | A50 | xx092 |
| A8 | xx022 | A51 | xx094 |
| A9 | xx024 | A52 | xx096 |
| A10 | xx026 | A53 | xx098 |
| A11 | xx028 | A54 | xx09A |
| A12 | xx02A | A55 | xx0A0 |
| A13 | xx030 | A56 | xx0A2 |
| A14 | xx032 | A57 | xx0A4 |
| A15 | xx034 | A58 | xx0A6 |
| A16 | xx036 | A59 | xx0A8 |
| A17 | xx038 | A60 | xx0AA |
| A18 | xx03A | A61 | xx0B0 |
| A19 | xx040 | A62 | xx0B2 |
| A20 | xx042 | A63 | xx0B4 |
| A21 | xx044 | A64 | xx0B6 |
| A22 | xx046 | A65 | xx0B8 |
| A23 | xx048 | A66 | xx0BA |
| A24 | xx04A | A67 | xx0C0 |
| A25 | xx050 | A68 | xx0C2 |
| A26 | xx052 | A69 | xx0C4 |
| A27 | xx054 | A70 | xx0C6 |
| A28 | xx056 | A71 | xx0C8 |
| A28 | xx058 | A72 | xx0CA |
| A29 | xx05A | A73 | xx0D0 |
| A30 | xx060 | A74 | xx0D2 |
| A31 | xx062 | A75 | xx0D4 |
| A32 | xx064 | A76 | xx0D6 |
| A33 | xx066 | A77 | xx0D8 |
| A34 | xx068 | A78 | xx0DA |

ANALOG INPUT LABEL TO DIOB ADDRESS CONVERSION:

| LABEL | DIOB ADDRESS |
|---|---|
| A35 | xx06A |
| A36 | xx070 |
| A37 | xx072 |
| A38 | xx074 |
| A39 | xx076 |
| A40 | xx078 |
| A41 | xx07A |
| A42 | xx080 |
| A43 | xx082 |
| A88 | xx0F6 |
| A89 | xx0F8 |
| A90 | xx0FA |
| A91 | xx100 |
| A92 | xx102 |
| A93 | xx104 |
| A94 | xx106 |
| A95 | xx108 |
| A96 | xx10A |
| A97 | xx110 |
| A98 | xx112 |
| A99 | xx114 |
| A100 | xx116 |
| A101 | xx118 |
| A102 | xx11A |
| A103 | xx120 |
| A140 | xx122 |
| A105 | xx124 |
| A106 | xx126 |
| A107 | xx128 |
| A108 | xx12A |
| A109 | xx130 |
| A110 | xx132 |
| A111 | xx134 |
| A112 | xx136 |
| A113 | xx138 |
| A114 | xx13A |
| A115 | xx140 |
| A116 | xx142 |
| A117 | xx144 |
| A118 | xx146 |
| A201 | xx01C |
| A202 | xx02C |
| A203 | xx03C |
| A204 | xx04C |
| A205 | xx05C |
| A206 | xx06C |
| A207 | xx07C |
| A208 | xx08C |
| A209 | xx09C |
| A210 | xx0AC |
| A211 | xx0BC |
| A212 | xx0CC |
| A301 | xx1C8 |
| A302 | xx1CA |
| A303 | xx1CC |
| A304 | xx1CE |
| A305 | xx1C0 |

| LABEL | DIOB ADDRESS |
|---|---|
| A79 | xx0E0 |
| A80 | xx0E2 |
| A81 | xx0E4 |
| A82 | xx0E6 |
| A83 | xx0E8 |
| A84 | xx0EA |
| A85 | xx0F0 |
| A86 | xx0F2 |
| A87 | xx0F4 |
| A119 | xx148 |
| A120 | xx14A |
| A121 | xx150 |
| A122 | xx152 |
| A123 | xx154 |
| A124 | xx156 |
| A125 | xx158 |
| A126 | xx15A |
| A127 | xx160 |
| A128 | xx162 |
| A129 | xx164 |
| A130 | xx166 |
| A131 | xx168 |
| A132 | xx16A |
| A133 | xx170 |
| A134 | xx172 |
| A135 | xx174 |
| A136 | xx176 |
| A137 | xx178 |
| A138 | xx17A |
| A139 | xx180 |
| A140 | xx182 |
| A141 | xx184 |
| A142 | xx186 |
| A143 | xx188 |
| A144 | xx18A |
| A145 | xx190 |
| A146 | xx192 |
| A147 | xx194 |
| A148 | xx196 |
| A149 | xx198 |
| A150 | xx19A |
| A213 | xx0DC |
| A214 | xx0EC |
| A215 | xx0FC |
| A216 | XX10C |
| A217 | XX11C |
| A218 | XX12C |
| A219 | XX13C |
| A220 | XX14C |
| A221 | XX15C |
| A222 | XX16C |
| A223 | XX17C |
| A224 | XX18C |
| A225 | XX19C |
| A341 | xx178 |
| A342 | xx17A |
| A343 | xx17C |
| A344 | xx17E |
| A345 | xx170 |

AUTO/MANUAL STATION LABEL TO DIOB ADDRESS CONVERSION:

| LABEL | DIOB ADDRESS | LABEL | DIOB ADDRESS |
|---|---|---|---|
| A306 | xx1C2 | A346 | xx172 |
| A307 | xx1C4 | A347 | xx174 |
| A308 | xx1C6 | A348 | xx176 |
| A309 | xx1B8 | A349 | xx160 |
| A310 | xx1BA | A350 | xx162 |
| A311 | xx1BC | A351 | xx164 |
| A312 | xx1BE | A352 | xx156 |
| A313 | xx1B0 | A353 | xx150 |
| A314 | xx1B2 | A354 | xx152 |
| A315 | xx1B4 | A355 | xx154 |
| A316 | xx1B6 | A356 | xx156 |
| A317 | xx1A8 | A357 | xx140 |
| A318 | xx1AA | A358 | xx142 |
| A319 | xx1AC | A359 | xx144 |
| A320 | xx1AE | A360 | xx146 |
| A321 | xx1A0 | A361 | xx130 |
| A322 | xx1A2 | A362 | xx132 |
| A323 | xx1A4 | A363 | xx134 |
| A324 | xx1A6 | A364 | xx136 |
| A325 | xx198 | A365 | xx120 |
| A326 | xx19A | A366 | xx122 |
| A327 | xx19C | A367 | xx124 |
| A328 | xx19E | A368 | xx126 |
| A329 | xx190 | A369 | xx110 |
| A330 | xx192 | A370 | xx112 |
| A331 | xx194 | A371 | xx114 |
| A332 | xx196 | A372 | xx116 |
| A333 | xx188 | A373 | xx1F0 |
| A334 | xx18A | A374 | xx1F2 |
| A335 | xx18C | A375 | xx1F4 |
| A336 | xx18E | A376 | xx1F6 |
| A337 | xx180 | A377 | xx1E0 |
| A338 | xx182 | A378 | xx1E2 |
| A339 | xx184 | A379 | xx1E4 |
| A340 | xx186 | A380 | xx1E6 |

APPENDIX D

Q-LINE CARD TYPE SPECIFICATIONS

The card type as required by the AIN, ANOUT, and TCIN algorithms are:

| Card Type | Range | Units | Card Names And Group Numbers |
|---|---|---|---|
| 1 | -20 to +20 | mV | QAI (go1), QAV (g01) |
| 2 | -50 to +50 | mV | QAI (go2), QAV (go2) |
| 3 | -100 to +100 | mV | QAI (go3) |
| 4 | -500 to +500 | mV | QAI (go4) |
| 5 | -1 to +1 | V | QAI (go5) |
| 6 | -10 to +10 | V | QAI (go6) |
| 7 | 0 to +20 | mA | QAI (go7) |
| 8 | -50 to +50 | mA | QAI (go8) |
| 9 | +4 to +20 | mA | QAI (go7) (software limited) |
| 11 | 0 to +10 | mV | QRT (go1) |
| 12 | 0 to +33 1/3 | mV | QRT (go2) |

| | | | |
|---|---|---|---|
| 13 | 0 to +1 | V | QAW (go1) |
| 14 | 0 to +5 | V | QAW (go2) |
| 15 | 0 to +10 | V | QAW (go3) |
| 16 | 0 to +20 | mA | QAW (go4) |
| 17 | -10 to +10 | V | QAH (go1) |
| 18 | -5 to +5 | V | QAH (go2) |
| 19 | 0 to +10 | V | QAH (go3) |
| 20 | 1 to +5 | V | QAH (go4) |
| 21 | 0 to +20 | mA | QAO (go1) |
| 22 | 0 to +10 | V | QAO (go2) |
| 23 | -10 to +10 | V | QAO (go3) |
| 24 | 0 to +5 | V | QAO (go4) |
| 25 | -5 to +5 | V | QAO (go5) |
| 26 | -10 to +10 | V | QAO (go6) |
| 27 | 0 to +20 | mA | QAO (go7) |
| 28 | -10 to +10 | V | QAO (go8) |
| 29 | +4 to +20 | mA | QAO (go9) (software limited) |

We claim:

1. A control apparatus for operating an extraction steam turbine-electric power generation system so as to allow a bumpless transfer into an extraction mode of operation for locally controlling extraction steam pressure in a predetermined local extraction pressure control loop, or for allowing a bumpless transfer from said predetermined local extraction pressure control loop into any one of three other extraction modes of operation, one for remotely controlling extraction steam pressure in a predetermined remote extraction pressure control loop, one for locally controlling extraction steam flow in a predetermined local extraction flow control loop, or one for remotely controlling extraction steam flow in a predetermined remote extraction flow control loop, said apparatus comprising:

a turbine extraction valve;

a valve controller means for positioning said extraction valve;

a pressure transmitter means for providing a pressure feedback signal corresponding to the existing level of said extraction steam pressure in said system;

a flow transmitter means for providing a flow feedback signal corresponding to the existing level of said extraction steam flow in said system;

an extraction control loop selection controller means for determining one of four transitional operating states, a first transitional operating state corresponding to entry into said predetermined local extraction pressure control loop, a second transitional operating state corresponding to entry into said predetermined remote extraction pressure control loop, a third transitional operating state corresponding to entry into said predetermined local extraction flow control loop, or a fourth transitional operating state corresponding to entry into said predetermined remote extraction flow control loop;

an operator panel means for determining the operation of said extraction control loop selection controller means in accordance with an operator selection at said operator panel means;

an extraction transition reference controller means for determining an extraction transition reference signal equal to said pressure feedback signal in said first or second transitional operating states or equal to said flow feedback signal in said third or fourth transitional operating states;

an extraction valve pressure transition setpoint controller means operative with said extraction transition reference controller means for determining an extraction valve pressure setpoint signal in said first or second transitional operating states in accordance with a predetermined function of said extraction transition reference signal, said pressure feedback signal and an existing extraction valve setpoint signal;

an extraction valve flow transition setpoint controller means operative with said extraction transition reference controller means for determining an extraction valve flow setpoint signal in said third or fourth transitional operating states in accordance with a predetermined function of said extraction transition reference signal, said flow feedback signal and said existing extraction valve setpoint signal; and an extraction valve setpoint selection controller means operative with said extraction valve pressure transition setpoint controller means and said extraction valve flow transition setpoint controller means for selecting said extraction valve pressure setpoint signal in said first or second transitional operating states or said extraction valve flow setpoint signal in said third or fourth transitional operating states and establishing said existing extraction valve setpoint signal operative with said valve controller means at the value of said selected setpoint signal.

2. The control apparatus of claim 1, wherein operation of said control apparatus in said first transitional operating state precedes operation in said second, said third or said fourth transitional operating states, and in which said control apparatus is generated through said first transitional operating state during a transition from any of said second, said third, or said fourth transitional operating states to any other of said second, said third, or said fourth transitional operating states.

3. A control apparatus for operating an extraction steam turbine-electric power generation system so as to allow a bumpless transfer into an extraction mode of operation in which adjustments to an extraction valve are made for locally controlling extraction steam pressure in a predetermined local extraction pressure control loop, or for allowing a bumpless transfer from said predetermined local extraction pressure control loop into any one of three other extraction modes of operation, one for remotely controlling extraction steam pressure through adjustments to said extraction valve in a predetermined remote extraction pressure control loop, one for locally controlling extraction steam flow through adjustments to said extraction valve in a predetermined local extraction flow control loop, or one for remotely controlling extraction steam flow through adjustments to said extraction valve in a predetermined remote extraction flow control loop, said apparatus comprising:

an extraction control loop selection controller means for determining one of four transitional operating states, a first transitional operating state corresponding to entry into said predetermined local extraction pressure control loop, a second transitional operating state corresponding to entry into said predetermined remote extraction pressure control loop, a third transitional operating state corresponding to entry into said predetermined local extraction flow control loop, or a fourth transitional operating state corresponding to entry into said predetermined remote extraction flow control loop;

an operator panel means for determining the operation of said extraction control loop selection controller means in accordance with an operator at said operator panel means;

an extraction transition reference controller means for determining an extraction transition reference signal equal to the existing level of said extraction steam pressure in said system in said first or second transitional operating states or equal to the existing level of said extraction steam flow in said system in said third or fourth transitional operating states;

an extraction valve pressure transition setpoint controller means operative with said extraction transition reference controller means for determining an extraction valve pressure setpoint signal in said first or second transitional operating states in accordance with a predetermined function of said extraction transition reference signal, said existing extraction steam pressure level and an existing extraction valve setpoint signal;

an extraction valve flow transition setpoint controller means operative with said extraction transition reference controller means for determining an extraction valve flow setpoint signal in said third or fourth transitional operating states in accordance with a predetermined function of said extraction transition reference signal, said existing extraction steam flow level and said existing extraction valve setpoint signal; and an extraction valve setpoint selection controller means operative with said extraction valve pressure transition setpoint controller means and said extraction valve flow transition setpoint controller means for selecting said extraction valve pressure setpoint signal in said first or second transitional operating states or said extraction valve flow setpoint signal in said third or fourth transitional operating states and establishing said existing extraction valve setpoint signal operative with said extraction valve at the value of said selected setpoint signal.

4. The control apparatus of claim 3, wherein operation of said control apparatus in said first transitional operating state precedes operation in said second, said third or said fourth transitional operating states, and in which said control apparatus is operated through said first transitional operating state during a transition from any of said second, said third, or said fourth transitional operating states to any other of said second, said third, or said fourth transitional operating states.

5. The control apparatus of claim 3, further comprising:

a reinsertion logic controller means for determining, in the presence of a set of predetermined system operating conditions, said first transitional operating state, said reinsertion logic controller means operative with said operator panel means and said extraction control loop selection controller means.

6. The control apparatus of claim 5, wherein said set of predetermined system operating conditions corresponds to an operation in which said control apparatus has been restored to operation after being inoperative concurrent with both generation of a megawatt output from said extraction steam turbine-electric power generation system and a position of said extraction valve corresponding to said extraction mode of operation.

7. The control apparatus of claim 3, further comprising a remote control means which tracks the existing level of said extraction steam pressure and said extraction steam flow in said system and generates an equivalent remote control pressure reference signal and an equivalent remote control flow reference signal, respectively, said remote control pressure reference signal and said remote control flow reference signal connected to said extraction transition reference controller means.

8. The control apparatus of claim 3 wherein said first transitional operating state is inoperable unless the existing megawatt output level from said system is above approximately 20% of the rated load of said system.

9. The control apparatus of claim 3, wherein a digital computer means and an input and output interface means having analog and digital conversion capability suitable for use in process environments are employed to provide said extraction control loop selection controller means, said extraction transition reference controller means, said extraction valve pressure transition setpoint controller means, said extraction valve flow transition setpoint controller means, said extraction valve setpoint selection controller means.

10. The control apparatus of claim 9, wherein said digital computer means is programmed to provide a set of modular functional control blocks which are employed to form said extraction control loop selection controller means, said extraction transition reference controller means, said extraction valve pressure transition setpoint controller means, said extraction valve flow transition setpoint controller means, and said extraction valve setpoint selection controller means.

11. The control apparatus of claim 10, wherein the names of said modular functional control blocks are entered into said digital computer means in an interactive fashion.

12. The control apparatus of claim 11, wherein a translator means handles said functional control blocks in accordance with the sequence of entry into said digital computer means to form a software application program, each line of said software application program corresponding to one modular functional control block.

13. The control apparatus of claim 12, wherein an interpreter means is employed to execute said software application program in said digital computer means on a line-by-line basis in accordance with the lines of the software application program.

14. A method of operating an extraction steam turbine-electric power generation system so as to allow a bumpless transfer into an extraction mode of operation for locally controlling extraction steam pressure through adjustments to an extraction valve in a predetermined local extraction pressure control loop, or for allowing a bumpless transfer into any one of three other extraction modes of operation, one for remotely controlling extraction steam pressure through adjustments to said extraction steam valve in a predetermined remote extraction pressure control loop, one for locally controlling extraction steam flow through adjustments to said extraction valve in a predetermined local extraction flow control loop, or one for remotely controlling extraction steam flow through adjustments to said extraction valve in a predetermined remote extraction flow control loop, said method comprising the steps of:

determining one of four transitional operating states, a first transitional operating state corresponding to entry into said local extraction pressure control loop, a second transitional operating state corresponding to entry into said predetermined remote extraction pressure control loop, a third transitional operating state corresponding to entry into said predetermined local extraction flow control loop, and a fourth transitional operating state corresponding to entry into said predetermined remote extraction flow control loop;

selecting said first transitional operating state prior to selection of said second, said third, or said fourth transitional operating state or selecting said first transitional operating state prior to selection of said second, said third, or said fourth transitional operating state when either of said second, said third, or said fourth transitional operating state was last selected;

determining, if in said first or said second transitional operating states, an extraction transition reference signal equal to the existing level of said pressure in said system, an extraction valve pressure setpoint signal in accordance with a predetermined function of said extraction transition reference signal, the existing level of said pressure in said system, and the existing adjustment of said extraction valve, and operating said extraction valve in accordance with said extraction valve pressure setpoint signal; and determining, if in said third or said fourth transitional operating states, an extraction transition reference signal equal to the existing level of said flow in said system, an extraction valve flow setpoint signal in accordance with a predetermined function of said extraction transition reference signal and the existing level of said flow in said system, and the existing adjustment of said extraction valve, and operating said extraction valve in accordance with said extraction valve flow setpoint signal.

* * * * *